US011300902B2

(12) United States Patent
Yamada et al.

(10) Patent No.: US 11,300,902 B2
(45) Date of Patent: Apr. 12, 2022

(54) FIXING DEVICE HAVING PREHEATING UNIT, BLOWING UNIT AND IMAGE FORMING APPARATUS

(71) Applicant: FUJIFILM BUSINESS INNOVATION CORP., Tokyo (JP)

(72) Inventors: Kosuke Yamada, Ebina (JP); Takayuki Yamashita, Ebina (JP); Yoshiki Shimodaira, Ebina (JP); Tetsuro Kodera, Ebina (JP); Tokuya Sakamoto, Ebina (JP); Masato Yamashita, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/342,060

(22) Filed: Jun. 8, 2021

(65) Prior Publication Data

US 2021/0294264 A1 Sep. 23, 2021

Related U.S. Application Data

(63) Continuation of application No. PCT/JP2019/028862, filed on Jul. 23, 2019.

(30) Foreign Application Priority Data

Jan. 31, 2019 (JP) ..... JP2019-016012

(51) Int. Cl.
*G03G 15/20* (2006.01)
*G03G 21/20* (2006.01)
*G03G 15/00* (2006.01)

(52) U.S. Cl.
CPC ..... *G03G 15/2021* (2013.01); *G03G 15/657* (2013.01); *G03G 21/206* (2013.01); *G03G 15/2017* (2013.01); *G03G 2215/2006* (2013.01)

(58) Field of Classification Search
CPC ..... G03G 15/2007; G03G 15/2021; G03G 15/657; G03G 21/206; G03G 2215/00413;
(Continued)

(56) References Cited

U.S. PATENT DOCUMENTS 5,086,209 A * 2/1992 Kintz ..... G03F 7/0032 219/216
7,010,260 B2 * 3/2006 Behnke ..... G03G 15/235 399/320
(Continued)

FOREIGN PATENT DOCUMENTS

JP 2002-148973 A 5/2002
JP 2009-163065 A 7/2009
(Continued)

OTHER PUBLICATIONS

Sep. 17, 2019 International Search Report issued in International Patent Application No. PCT/JP2019/028862.
Sep. 17, 2019 Written Opinion of the International Searching Authority issued in International Patent Application No. PCT/JP2019/028862.

*Primary Examiner* — Robert B Beatty
(74) *Attorney, Agent, or Firm* — Oliff PLC

(57) ABSTRACT

A fixing device includes: a preheating unit configured to heat a recording medium above the recording medium in a non-contact state with the recording medium, the recording medium being held at a leading end of the recording medium having a recording surface on which an image is transferred, the recording medium being transported such that the recording surface faces upward; a blowing unit disposed on a side opposite to the preheating unit with respect to the recording medium and configured to blow air onto the recording medium below the recording medium; a main heating unit disposed on a downstream side of the preheating unit in a transport direction of the recording medium and configured to contact the recording medium to heat the
(Continued)

recording medium; a detection unit disposed on an upstream side of the preheating unit in the transport direction and configured to detect a transport posture of the recording medium; and a control unit configured to control the blowing unit based on a detection result of the detection unit to adjust an amount of air to be blown to the recording medium.

20 Claims, 18 Drawing Sheets

(58) Field of Classification Search
CPC . G03G 2215/00666; G03G 2215/2006; G03G 2215/1671
USPC ..... 399/69, 92, 341, 336, 400
See application file for complete search history.

(56) References Cited

U.S. PATENT DOCUMENTS

| | | | | |
|---|---|---|---|---|
| 2008/0317528 | A1 | 12/2008 | Lee et al. | |
| 2010/0092199 | A1* | 4/2010 | Biegelsen ..... | G03G 15/2039 399/68 |
| 2014/0064809 | A1* | 3/2014 | Yamaguchi ..... | G03G 15/6573 399/341 |
| 2021/0286304 | A1* | 9/2021 | Shimodaira ..... | G03G 15/2053 |
| 2021/0286305 | A1* | 9/2021 | Sakamoto ..... | G03G 15/2053 |

FOREIGN PATENT DOCUMENTS

| | | | |
|---|---|---|---|
| JP | 2010-122568 | A | 6/2010 |
| JP | 2011-48148 | A | 3/2011 |

* cited by examiner

FIXING DEVICE HAVING PREHEATING UNIT, BLOWING UNIT AND IMAGE FORMING APPARATUS

CROSS REFERENCE TO RELATED APPLICATIONS

This is a continuation of International Application No. PCT/JP2019/028862 filed on Jul. 23, 2019, and claims priority from Japanese Patent Application No. 2019-016012 filed on Jan. 31, 2019.

BACKGROUND

Technical Field

The present invention relates to a fixing device and an image forming apparatus.

Related Art

In an image forming apparatus disclosed in Patent Literature 1, a transport pulley is rotated by a rotary drive source to drive a transport member and a transport auxiliary member so as to transport a transfer material, an unfixed toner image is heated and melted by radiation heat, and the transfer material is transported to a guide member at an inlet of a calendar roller.

CITATION LIST

Patent Literature

Patent Literature 1: JP-A-2002-148973

SUMMARY

In the related art, a fixing device includes a preheating unit that heats a recording medium above the recording medium in a non-contact state with the recording medium, the recoding medium having a recording surface on which an image is transferred, the recording medium being held at a leading end portion and transported such that the recording surface faces upward. Further, the fixing device includes a blowing portion that stabilizes the transport posture of the recording medium by blowing air to the recording medium from the side opposite to the preheating portion with respect to the recording medium.

In such a fixing device, a detection unit that detects the transport posture of the recording medium is disposed between the preheating unit and the blowing unit. The amount of air blown onto the recording medium by the blowing unit is adjusted based on the detection result of the detection unit.

In this way, since the detection unit is disposed between the preheating unit and the blowing unit, when the image is fixed to plural recording media, the detection unit detects the transport posture of the first recording medium, and the blowing unit blows air from the second recording medium. That is, the transport posture cannot be stabilized from the first recording medium heated by the preheating unit.

Aspects of non-limiting embodiments of the present disclosure relate to stabilize the transport posture of the recording media from the first recording medium heated by the preheating unit, compared to the case where the detection unit is disposed between the preheating unit and the blowing unit.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device including:

a preheating unit configured to heat a recording medium above the recording medium in a non-contact state with the recording medium, the recording medium being held at a leading end of the recording medium having a recording surface on which an image is transferred, the recording medium being transported such that the recording surface faces upward;

a blowing unit disposed on a side opposite to the preheating unit with respect to the recording medium and configured to blow air onto the recording medium below the recording medium;

a main heating unit disposed on a downstream side of the preheating unit in a transport direction of the recording medium and configured to contact the recording medium to heat the recording medium;

a detection unit disposed on an upstream side of the preheating unit in the transport direction and configured to detect a transport posture of the recording medium; and a control unit configured to control the blowing unit based on a detection result of the detection unit to adjust an amount of air to be blown to the recording medium.

BRIEF DESCRIPTION OF DRAWINGS

Exemplary embodiment(s) of the present invention will be described in detail based on the following figures, wherein.

DETAILED DESCRIPTION

Figure 1:
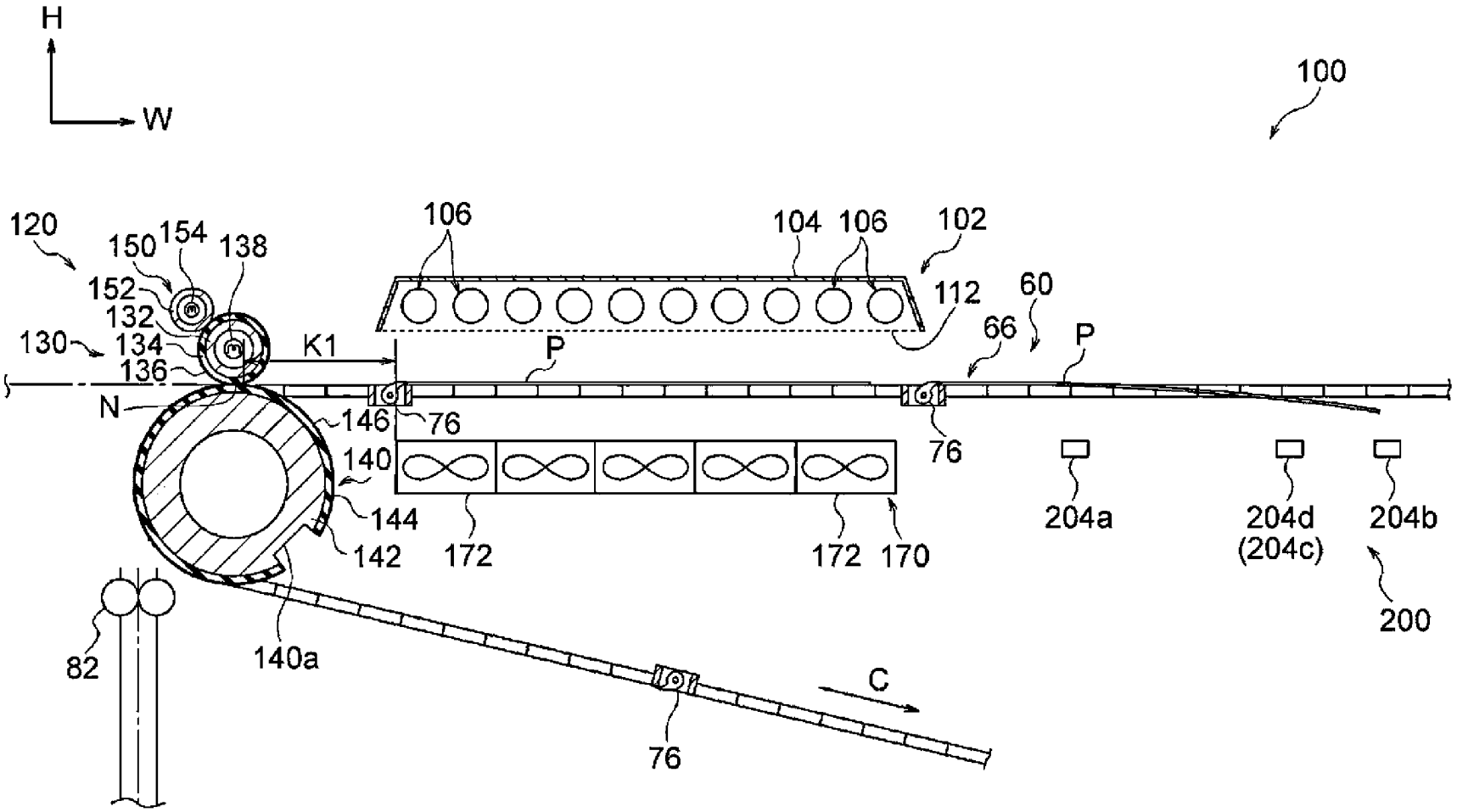
FIG. 1 is a configuration view illustrating a fixing device according to an exemplary embodiment of the present invention.

Exemplary embodiment of a fixing device and an image forming apparatus will be described with reference to FIGS. 1 to 16. In the drawings, an arrow H indicates the apparatus upper-lower direction (vertical direction), an arrow W indicates the apparatus width direction (horizontal direction), and an arrow D indicates the apparatus depth direction (horizontal direction).

(Image Forming Apparatus 10)

Figure 14:
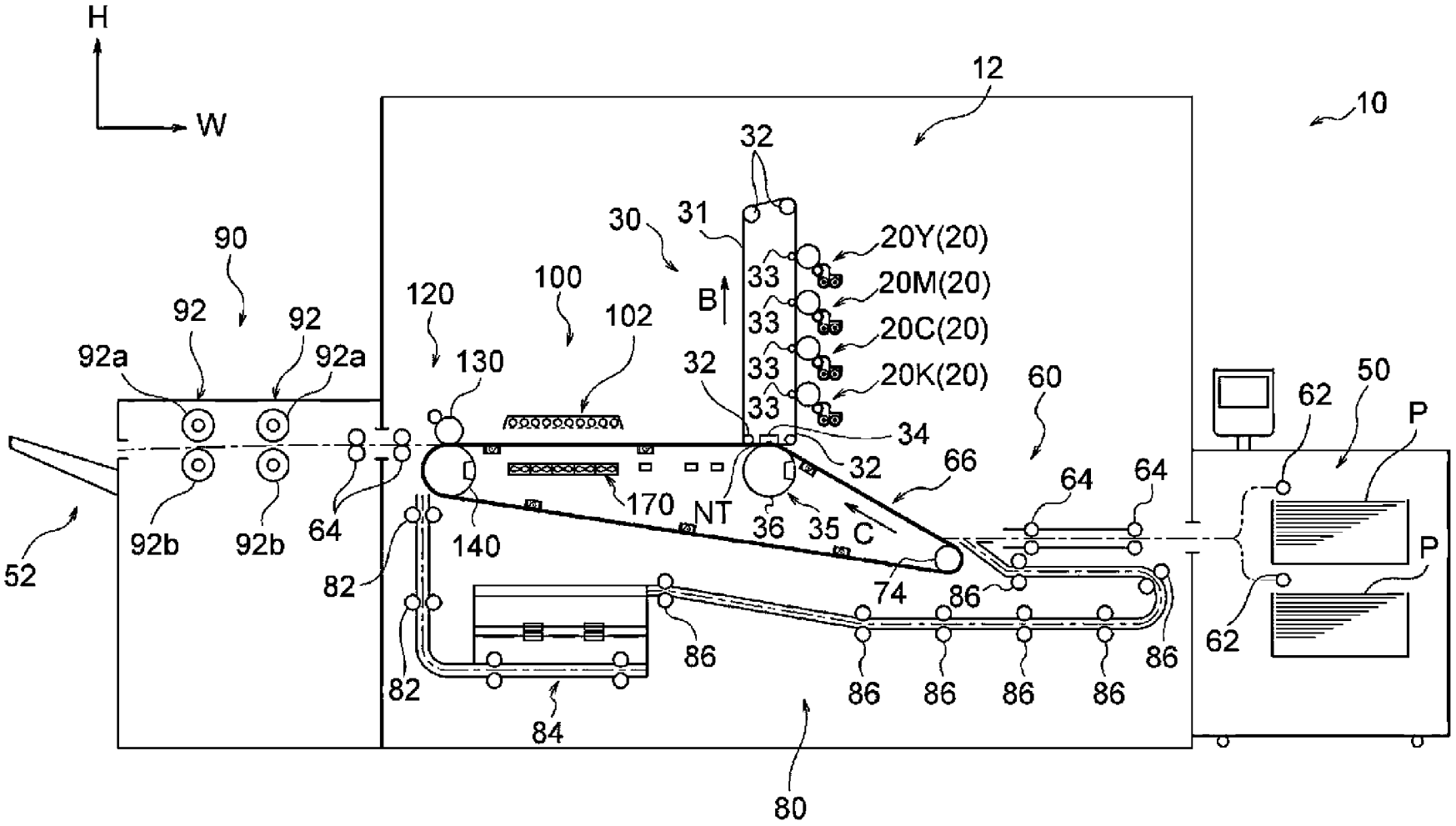
FIG. 14 is a configuration view illustrating an image forming apparatus according to an exemplary embodiment of the present invention.

The image forming apparatus 10 according to the exemplary embodiment is an electrophotographic image forming apparatus that forms a toner image on a sheet member P. As illustrated in FIG. 14, the image forming apparatus 10 includes an accommodating unit 50, a discharging unit 52, an image forming unit 12, a transport mechanism 60, a reversing mechanism 80, a fixing device 100, and a cooling unit 90.

[Accommodating Unit 50]

The accommodating unit 50 has a function of accommodating the sheet member P as a recording medium. In the image forming apparatus 10, plural (for example, two) accommodation units 50 are provided. The sheet member P is selectively fed from the plural accommodating units 50.

[Discharging Unit 52]

The discharging unit 52 is a portion where the sheet member P on which an image is formed is discharged. Specifically, after the image is fixed by the fixing device 100, the sheet member P cooled by the cooling unit 90 is discharged to the discharging unit 52.

[Image Forming Unit 12]

The image forming unit 12 has a function of forming an image on the sheet member P by an electrophotographic method. Specifically, the image forming unit 12 includes a toner image forming unit 20 that forms a toner image, and a transfer device 30 that transfers the toner image formed by the toner image forming unit 20 to the sheet member P.

Plural toner image forming units 20 are provided so as to form a toner image for each color. The image forming apparatus 10 includes the toner image forming units 20 of a total of four colors of yellow (Y), magenta (M), cyan (C), and black (K). (Y), (M), (C), and (K) illustrated in FIG. 14 show constituent portions corresponding to the respective colors.

—Toner Image Forming Unit 20—

Figure 13:
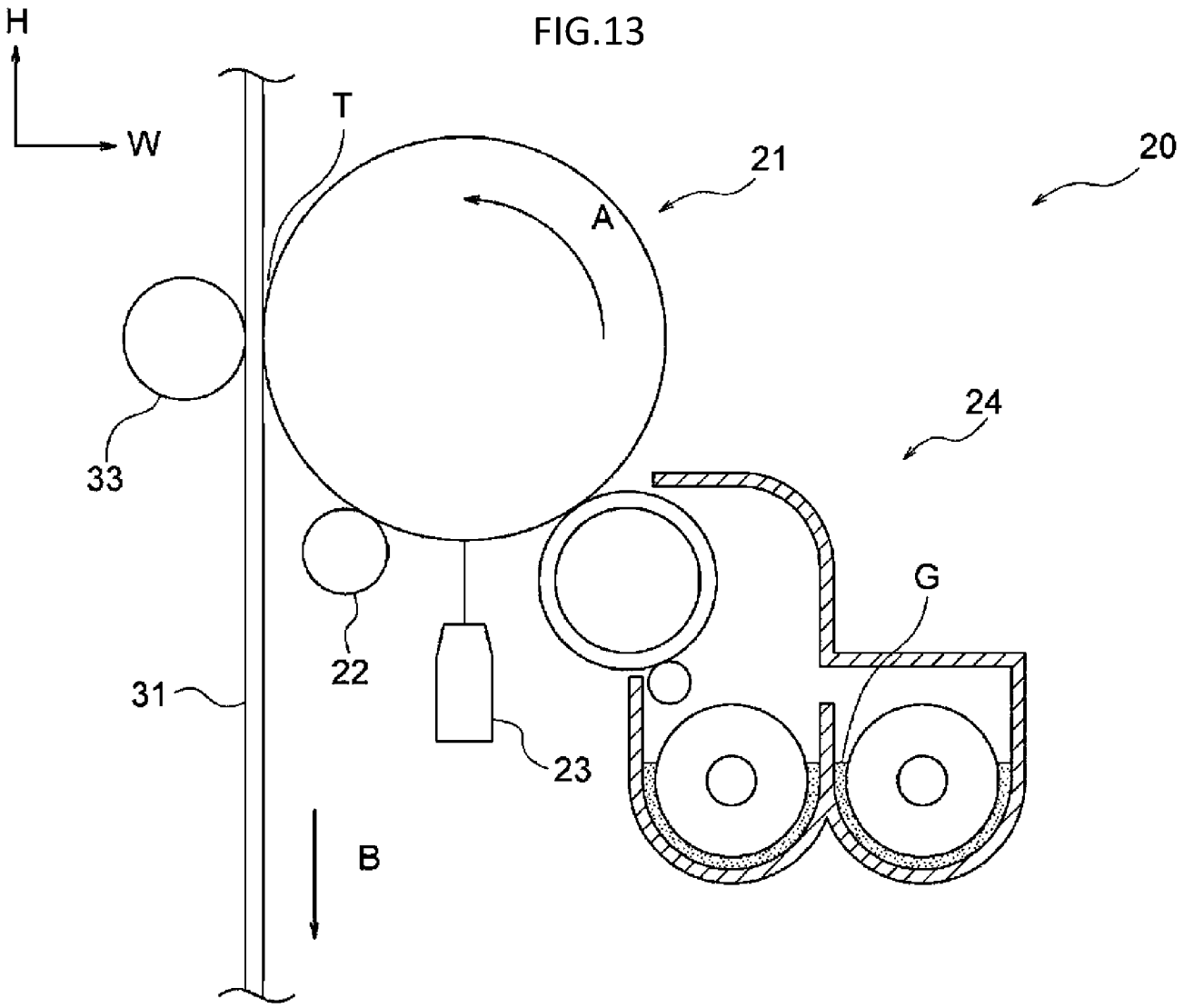
FIG. 13 is a configuration view illustrating a toner image forming unit of the image forming apparatus according to the exemplary embodiment of the present invention.

The toner image forming unit 20 of each color is basically configured in the same manner except for the toner to be used. Specifically, as illustrated in FIG. 13, the toner image forming unit 20 of each color includes a photosensitive drum 21 (photoconductor) that rotates in the direction of an arrow A in the drawing, and a charger 22 that charges the photosensitive drum 21. The toner image forming unit 20 of each color includes an exposure device 23 that exposes the photosensitive drum 21 charged by the charger 22 to light to form an electrostatic latent image on the photosensitive drum 21, and a developing device 24 that uses the toner to develop the electrostatic latent image formed on the photosensitive drum 21 by the exposure device 23 to form a toner image.

—Transfer Device 30—

The transfer device 30 has a function of primarily transferring toner images of the photosensitive drums 21 of the respective colors onto an intermediate transfer body in a superimposed manner, and secondarily transferring the superimposed toner images onto the sheet member P. Specifically, as illustrated in FIG. 14, the transfer device 30 includes a transfer belt 31 as an intermediate transfer member, a primary transfer roller 33, and a transfer unit 35.

The primary transfer roller 33 has a function of transferring the toner image formed on the photosensitive drum 21 to the transfer belt 31 at a primary transfer position T (see FIG. 13) between the photosensitive drum 21 and the primary transfer roller 33.

The transfer belt 31 has an endless shape and is wound around plural rollers 32 to determine a posture of the transfer belt 31. When at least one of the rollers 32 is rotationally driven, the transfer belt 31 circulates in an arrow B direction, and transports the primarily transferred image to a secondary transfer position NT.

The transfer unit 35 has a function of transferring the toner image transferred to the transfer belt 31 to the sheet member P. Specifically, the transfer unit 35 includes a secondary transfer unit 34 and a facing roller 36.

The facing roller 36 is disposed below the transfer belt 31 so as to face the transfer belt 31. The secondary transfer unit 34 is disposed on an inner side of the transfer belt 31 such that the transfer belt 31 is disposed between the facing roller 36 and the secondary transfer unit 34. The secondary transfer unit 34 is specifically configured by a corotron. In the transfer unit 35, the toner image transferred to the transfer belt 31 is transferred to the sheet member P passing through the secondary transfer position NT by an electrostatic force generated by the discharge of the secondary transfer unit 34.

[Transport Mechanism 60]

The transport mechanism 60 has a function of transporting the sheet member P accommodated in the accommodating unit 50 to the secondary transfer position NT. Further, the transport mechanism 60 has a function of transporting the sheet P from the secondary transfer position NT to the main heating unit 120 to be described later.

Specifically, the transport mechanism 60 includes a feeding roller 62, plural transport rollers 64, and a chain gripper 66.

Figure 6:
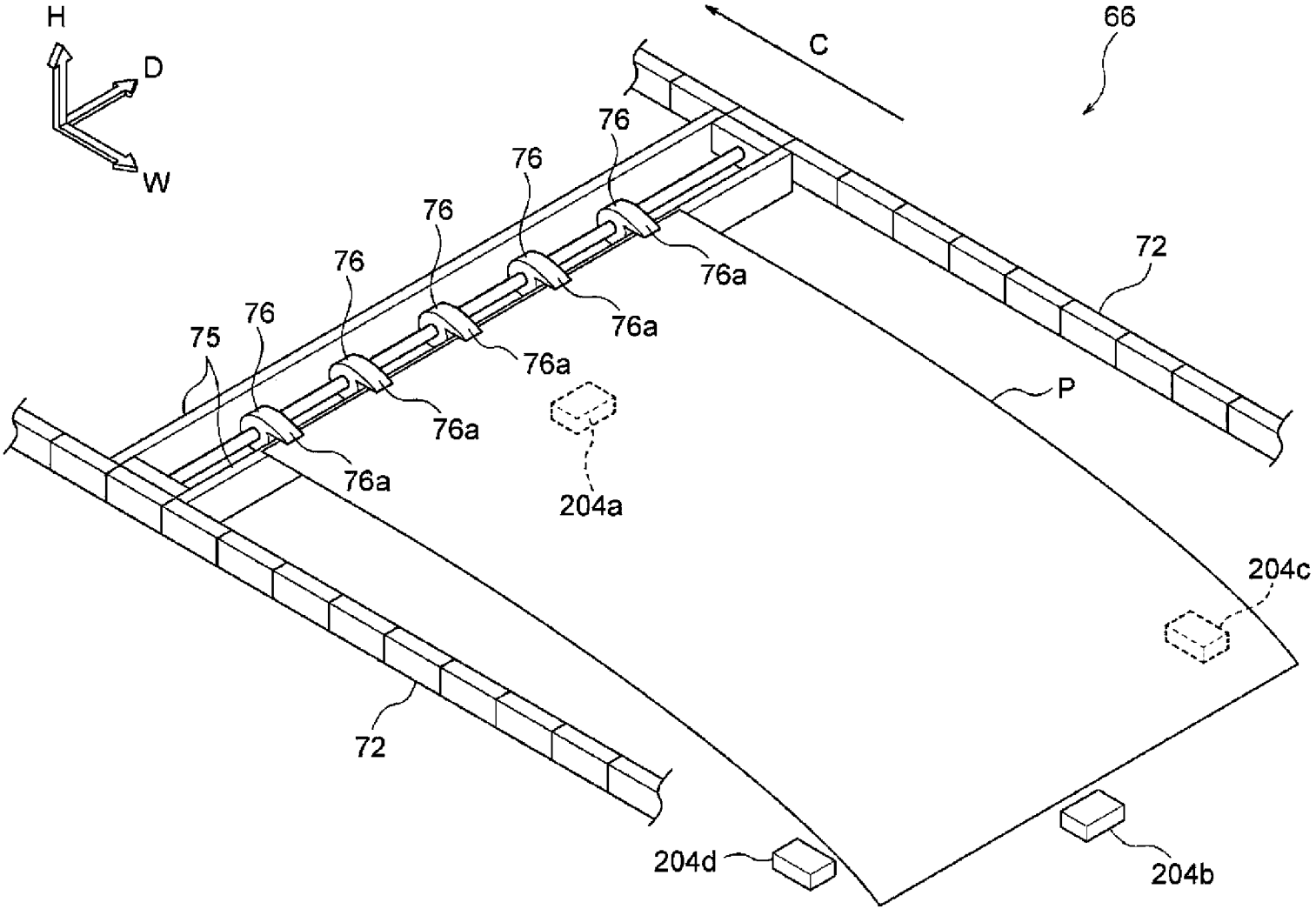
FIG. 6 is a perspective view illustrating a detection unit of the fixing device according to the exemplary embodiment of the present invention.

The feeding roller 62 is a roller that feeds out the sheet member P accommodated in the accommodating unit 50. The plural transport rollers 64 are rollers that transports the sheet member P fed by the feeding roller 62 to the chain gripper 66 or a roller that transports the sheet member P transported by the chain gripper 66 to the cooling unit 90. The chain gripper 66 has a function of holding the leading end portion of the sheet member P and transporting the sheet member P. Specifically, as shown in FIG. 6, the chain gripper 66 includes a pair of chains 72 and a gripper 76 as a holding portion (=grip portion).

The pair of chains 72 is formed in an annular shape. The pair of chains 72 is disposed at intervals in the apparatus depth direction. The pair of chains 72 is wound around a pair of sprockets (not illustrated) disposed on one end side and the other end side in the axial direction with respect to the facing roller 36, a pair of sprockets 71 (see FIG. 7) disposed on one end side and the other end side in the axial direction with respect to a pressing roller 140 described later, and a pair of sprockets 74 (see FIG. 14) disposed at intervals in the apparatus depth direction. When one of the pair of sprockets rotates, the chains 72 circulate in the arrow C direction.

Further, an attachment member 75 to which the gripper 76 is attached is stretched along the apparatus depth direction in the pair of chains 72. Plural attachment members 75 are provided, and are fixed to the pair of chains 72 at predetermined intervals along the peripheral direction (circulation direction) of the chains 72.

Plural grippers 76 are provided, and the grippers 76 are attached to the attachment member 75 at predetermined intervals along the apparatus depth direction. The gripper 76 has a function of holding the leading end portion of the sheet member P. Specifically, the gripper 76 has a claw 76*a*. A contact portion 75*a* (see FIG. 8) with which the claw 76*a* comes into contact is formed in the attachment member 75.

The gripper 76 is configured to hold the sheet member P by clamping the leading end portion of the sheet member P between the claw 76*a* and the contact portion 75*a*. In the gripper 76, for example, the claw 76*a* is pressed against the contact portion 75*a* by a spring or the like, and the claw 76*a* is brought into contact with and separated from the contact portion 75*a* by the action of a cam or the like.

In the chain gripper 66, the chain 72 circulates in the arrow C direction in a state in which the gripper 76 holds the leading end portion of the sheet member P, so that the sheet member P is transported. The chain gripper 66 shown in FIG. 14 transports the sheet member P transported by the plural transport rollers 64 to the secondary transfer position NT, passes the sheet member P through a preheating unit 102 described later, and then transports the sheet member P to a main heating unit 120 described later. In the transport mechanism 60, a part of the transport path through which the sheet member P is transported is indicated by an alternate long and short dash line.

In this configuration, the transport mechanism 60 transports the sheet member P in the apparatus width direction at least from the secondary transfer position NT to the main heating unit 120 such that the sheet surface is oriented in the upper-lower direction.

[Reversing Mechanism 80]

The reversing mechanism 80 is a mechanism that reverses the front and back of the sheet member P. Specifically, as illustrated in FIG. 14, the reversing mechanism 80 includes plural transport rollers 82, a reversing device 84, and plural transport rollers 86.

The transport rollers 82 transport the sheet member P fed from the fixing device 100 to the reversing device 84. As an example, the reversing device 84 is a device that twists the seat member P like a Mobius strip to reverse the front and back of the sheet member P by transporting the sheet member P while folding the sheet member P plural times such that the transport direction of the sheet member P is changed by, for example, 90 degrees.

The plural transport rollers 86 are rollers that transport the sheet member P, whose front and back are reversed by the reversing device 84, to the chain gripper 66.

[Fixing Device 100]

The fixing device 100 has a function of fixing the toner image transferred to the sheet member P by the transfer device 30 to the sheet member P. The fixing device 100 will be described in detail later.

[Cooling Unit 90]

The cooling unit 90 has a function of cooling the sheet member P heated by the fixing device 100. As illustrated in FIG. 14, the cooling unit 90 is disposed on the downstream side of the fixing device 100 in the transport direction of the sheet member P. The cooling unit 90 includes two cooling rollers 92 disposed in the apparatus width direction. Since the two cooling rollers 92 have the same configuration, one of the cooling rollers 92 will be described.

Figure 11:
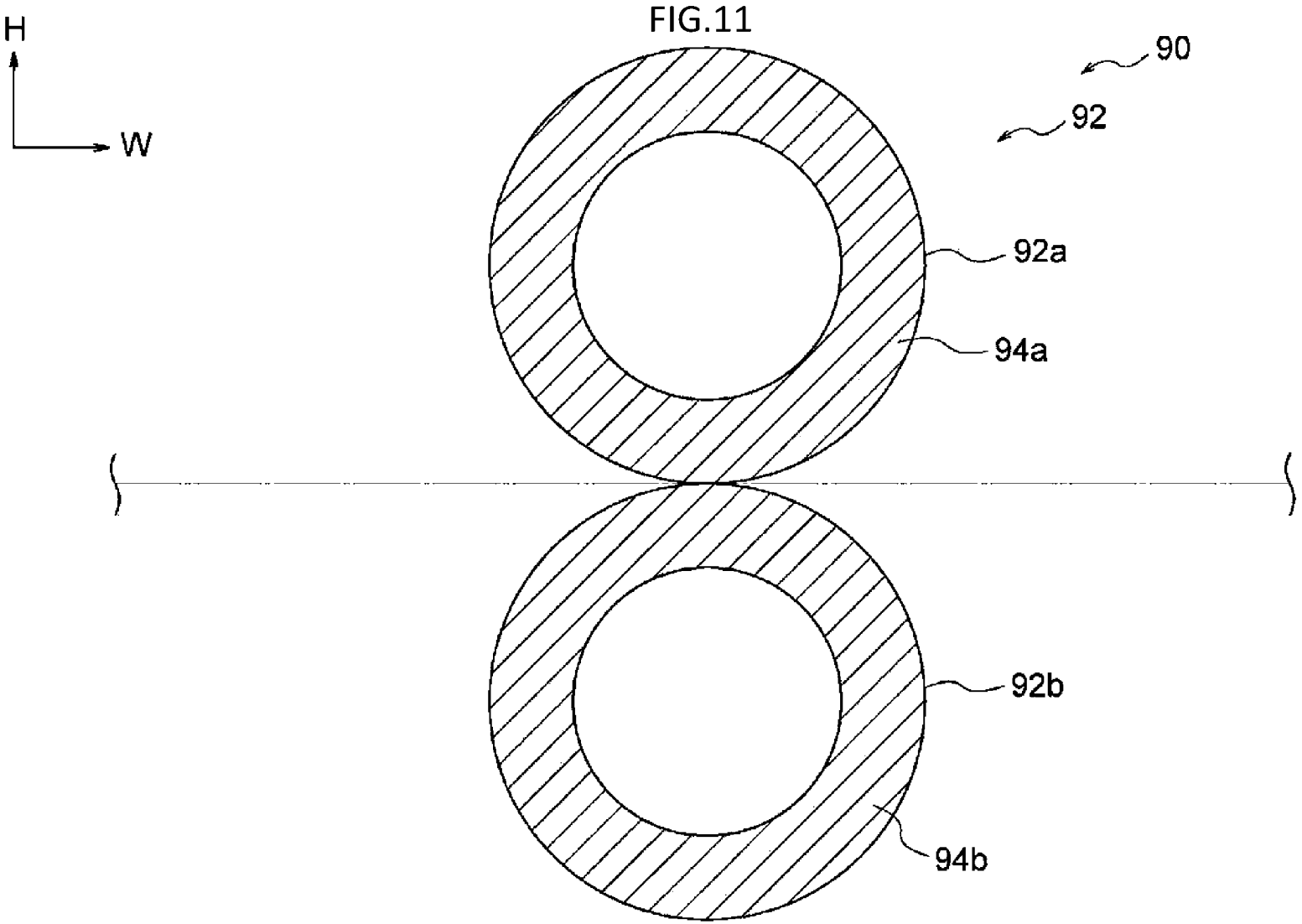
FIG. 11 is a view illustrating the amount of air blown from a fan of the fixing device according to the exemplary embodiment of the present invention to the sheet member and the elapsed time in a graph.

As illustrated in FIG. 11, the cooling roller 92 includes a roller 92*a* disposed on the upper side of the transport path of the sheet member P, and a roller 92*b* disposed on the lower side of the transport path of the sheet member P.

The rollers 92*a*, 92*b* have a cylindrical shape extending in the apparatus depth direction, and have cylindrical base member 94*a*, 94*b*. The base members 94*a*, 94*b* are aluminum pipes, and flow of air generated by a blowing mechanism (not shown) is generated inside the base members 94*a*, 94*b*. Due to the flow of the air, the temperature of the surfaces of the rolls 92*a*, 92*b* decreases as compared with the temperature in the case where the flow of the air does not occur.

In this configuration, the roller 92*b* is rotated by a rotational force from a driving member (not shown). Further, the roller 92*a* is rotated following the roller 92*b*. The rollers 92*a*, 92*b* transport the sheet member P while nipping the sheet member P between the rollers 92*a*, 92*b*, and cool the sheet member P.

(Operation of Image Forming Apparatus)

In the image forming apparatus 10 illustrated in FIG. 14, an image is formed as follows.

First, the charger 22 (see FIG. 13) of each color to which a voltage is applied uniformly negatively charges the surface of the photosensitive drum 21 of each color at a predetermined potential. Subsequently, the exposure device 23 irradiates the surface of the charged photosensitive drum 21 of each color with exposure light to form an electrostatic latent image based on the image data input from the outside.

Accordingly, an electrostatic latent image corresponding to the image data is formed on the surface of each photosensitive drum 21. Further, the developing device 24 of each color develops the electrostatic latent image and visualizes the electrostatic latent image as a toner image. The transfer device 30 transfers the toner image formed on the surface of the photosensitive drum 21 of each color to the transfer belt 31.

Therefore, the sheet member P, which is fed from the accommodating unit 50 illustrated in FIG. 14 to the transport path of the sheet member P by the feeding roller 62 and transported by the chain gripper 66, is fed to the secondary transfer position NT in which the transfer belt 31 and the facing roller 36 are in contact with each other. At the secondary transfer position NT, the sheet member P is nipped and transported by the transfer belt 31 and the facing roller 36, so that the toner image on the surface of the transfer belt 31 is transferred to the surface of the sheet member P.

Further, the fixing device 100 fixes the toner image transferred to the surface of the sheet member P to the sheet member P, and the sheet member P is transported to the cooling unit 90. The cooling unit 90 cools the sheet member P to which the toner image is fixed and discharges the sheet member P to the discharging unit 52.

When a toner image is formed on the back surface of the sheet member P, the sheet member P that has passed through the fixing device 100 by being transported by the chain gripper 66 is transported to the transport roller 82 of the reversing mechanism 80, and the front and back of the sheet member P transported by the transport roller 82 are reversed by the reversing device 84. Further, the transport rollers 86 transport the sheet member P, whose front and back surfaces are reversed, to the chain gripper 66. The chain gripper 66 transports the sheet member P. Then, in order to form a toner image on the back surface of the sheet member P, the above-described steps are performed again.

(Configuration of Main Parts)

Next, the fixing device 100 will be described.

As illustrated in FIG. 1, the fixing device 100 is disposed on the downstream side of the transfer device 30 in the transport direction of the sheet member P and includes a preheating unit 102 that heats the sheet member P in a non-contact state with the transported sheet member P. The fixing device 100 further includes a main heating unit 120 that comes into contact with the sheet member P and heats and presses the sheet member P, a blowing unit 170, a detection unit 200 that detects a transport posture of the sheet member P, and a control unit 230 that controls each unit.

[Preheating Unit 102]

The preheating unit 102 is disposed on the downstream side of the secondary transfer position NT at which the toner image is transferred to the sheet member P in the transport direction of the sheet member P, and is disposed above the transported sheet member P (=the side to which the toner image is transferred), as illustrated in FIG. 1. The preheating unit 102 includes a reflecting plate 104, plural infrared heaters 106 (hereinafter, referred to as "heaters 106"), and a wire mesh 112.

—Reflecting Plate 104—

The reflecting plate 104 is formed of an aluminum plate, and has a shallow bottomed box shape opened on a side of the sheet member P being transported. In the exemplary embodiment, when viewed from above, the reflecting plate 104 covers the transported sheet member P in the apparatus depth direction.

—Heater 106—

The heater 106 is an infrared heater having a cylindrical outer shape, and is disposed so as to be accommodated inside the reflecting plate 104 and to extend in the apparatus depth direction. In the exemplary embodiment, when viewed from above, the heater 106 covers the transported sheet member P in the apparatus depth direction. Further, the heater 106 is separated by 30 mm in the upper-lower direction as an example from the transported sheet member P.

Further, the plural heaters 106 are disposed in the apparatus width direction. In the exemplary embodiment, when viewed from above, the region where the plural heaters 106 are disposed covers the transported sheet member P in the apparatus width direction. In other words, the plural heaters 106 heat the entire transported sheet members P at a time.

In the above configuration, the heater 106 radiates infrared rays having a maximum spectral radiance at a wavelength of 3 μm or more and 5 μm or less, and the surface temperature of the heater 106 is a predetermined temperature of 300° C. or more and 1175° C. or less.

—Wire Mesh 112—

The wire mesh 112 is fixed to an edge portion of the reflecting plate 104 by a fixing member (not shown), and partitions the inside of the reflecting plate 104 and the outside of the reflecting plate 110 from each other. Thus, the wire mesh 112 prevents the transported sheet member P from coming into contact with the heater 106.

[Blowing unit 170]

Figure 4:
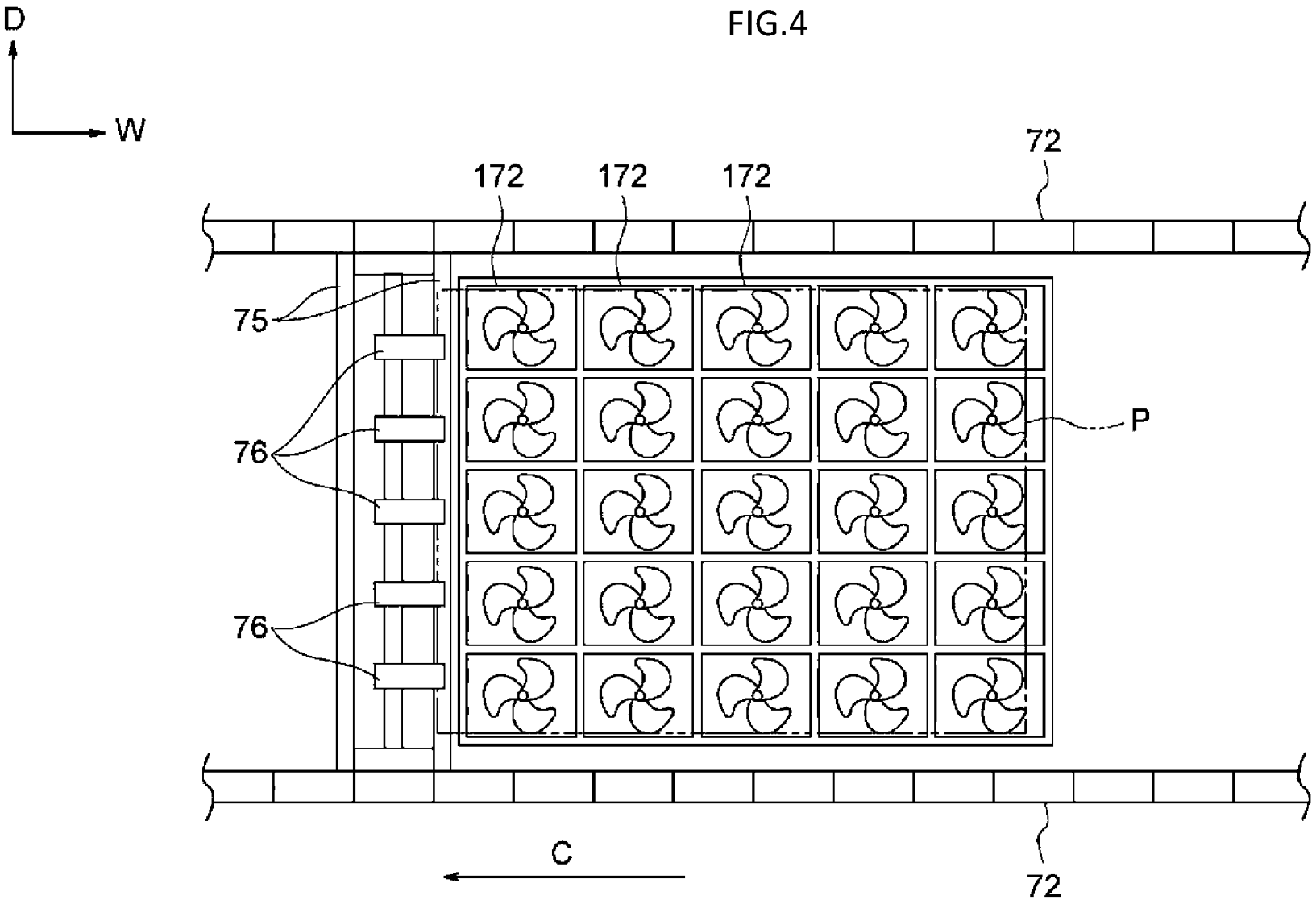
FIG. 4 is a plan view showing a blowing unit of the fixing device according to the exemplary embodiment of the present invention.

As shown in FIG. 1, the blowing unit 170 is disposed so as to face the preheating unit 102 in the upper-lower direction, and the transported sheet member P passes between the blowing unit 170 and the preheating unit 102. As illustrated in FIG. 4, the blowing unit 170 includes plural fans 172 arranged in the apparatus width direction and the apparatus depth direction. The fan 172 is an example of a blowing unit.

In this configuration, the plural fans 172 blow air toward the transported sheet member P, so that the transport posture of the transported sheet member P is stabilized. In this way, the fan 172 functions as a posture stabilizing means for stabilizing the transport posture of the transported sheet member P.

Here, the phrase "the transport posture of the sheet member P is stabilized" means that the distance from the sheet surface of the sheet member P to the preheating unit 102 is suppressed from varying depending on the position of the sheet surface. In other words, the difference between the longest distance and the shortest distance from the sheet surface of the sheet member P to the preheating portion 102 is reduced.

[Main Heating Unit 120]

As illustrated in FIG. 1, the main heating unit 120 is disposed on the downstream side of the preheating unit 102 in the transport direction of the sheet member P. The main heating unit 120 includes a heating roller 130 that comes into contact with the transported sheet member P to heat the sheet member P, a pressing roller 140 that presses the sheet member P toward the heating roller 130, and a driven roller 150 that is driven to rotate by the rotating heating roller 130.

—Heating Roller 130—

As illustrated in FIG. 1, the heating roller 130 is disposed so as to come into contact with a surface of the transported sheet member P facing upward and extend in the apparatus depth direction with the axial direction of the heating roller 130 as the apparatus depth direction. The heating roller 130 includes a cylindrical base member 132, a rubber layer 134 formed so as to cover the entire periphery of the base member 132, a release layer 136 formed so as to cover the entire periphery of the rubber layer 134, and a heater 138 accommodated inside the base member 132. The outer diameter of the outer peripheral surface of the release layer 136 in the heating roller 130 is, for example, 80 mm.

The base member 132 is an aluminum tube, and has a thickness of 20 mm, for example. The rubber layer 134 is made of silicone rubber, and has a thickness of 6 mm, for example. Further, the release layer 136 is made of a copolymer of tetrafluoroethylene and perfluoroethylene (PFA resin), and has a thickness of 50 μm, for example.

Figure 7:
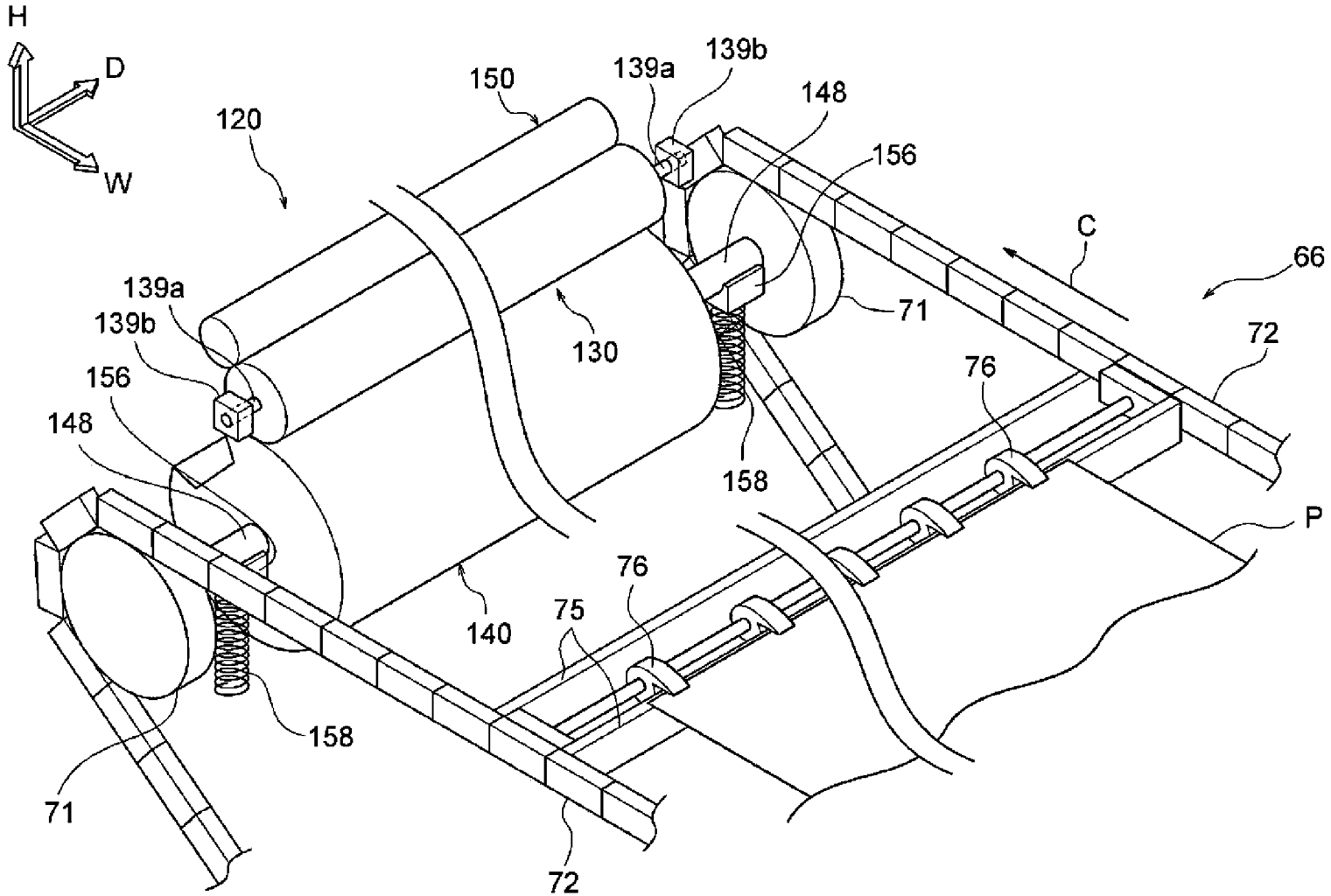
FIG. 7 is a perspective view illustrating a main heating unit of the fixing device according to the exemplary embodiment of the present invention.

Further, as shown in FIG. 7, shaft portions 139*a* extending in the apparatus depth direction are formed at both end portions of the heating roller 130 in the apparatus depth direction, respectively, and support members 139*b* supporting the shaft portions 139*a* are provided. Accordingly, the heating roller 130 is rotatably supported by the support members 139*b* at both end portions of the heating roller 130.

—Driven Roller 150—

As illustrated in FIGS. 1 and 7, the driven roller 150 is disposed so as to extend in the apparatus depth direction with the axial direction as the apparatus depth direction on the opposite side to the transported sheet member P with respect to the heating roller 130. The driven roller 150 includes a cylindrical base member 152 and a heater 154 accommodated inside the base member 152. The outer diameter of the outer circumferential surface of the base member 152 of the driven roller 150 is 50 mm, for example.

The base member 152 is an aluminum tube, and has a thickness of 10 mm, for example. The driven roller 150 is rotatably supported by support members (not shown) at both end portions of the driven roller 150.

In this configuration, the driven roller 150 is driven to rotate by the heating roller 130. The driven roller 150 then heats the heating roller 130. In this way, since the heating roller 130 is heated by the driven roller 150 and the heating roller 130 itself has the heater 138, the surface temperature of the heating roller 130 becomes a predetermined value of 180° C. or more and 200° C. or less.

—Pressing Roller 140—

As illustrated in FIGS. 1 and 7, the pressing roller 140 is disposed so as to come into contact with a surface of the transported sheet member P facing downward on the opposite side of the heating roller 130 with respect to the transported sheet member P, and to extend in the apparatus depth direction with the axial direction as the apparatus depth direction. The pressing roller 140 includes a cylindrical base member 142, a rubber layer 144 formed so as to cover the base member 142, a release layer 146 formed so as to cover the rubber layer 144, and a pair of shaft portions 148 (see FIG. 7) formed at both end portions in the apparatus depth direction. The outer diameter of the outer peripheral surface of the release layer 146 in the pressing roller 140 is 225 mm, for example. In this way, the outer diameter of the pressing roller 140 is larger than the outer diameter of the heating roller.

The base member 142 is an aluminum tube, and has a thickness of 20 mm, for example. The rubber layer 144 is made of silicone rubber, and has a thickness of 1 mm, for example. Further, the release layer 146 is made of a copolymer of tetrafluoroethylene and perfluoroethylene (PFA resin), and has a thickness of 50 for example.

Figure 8:
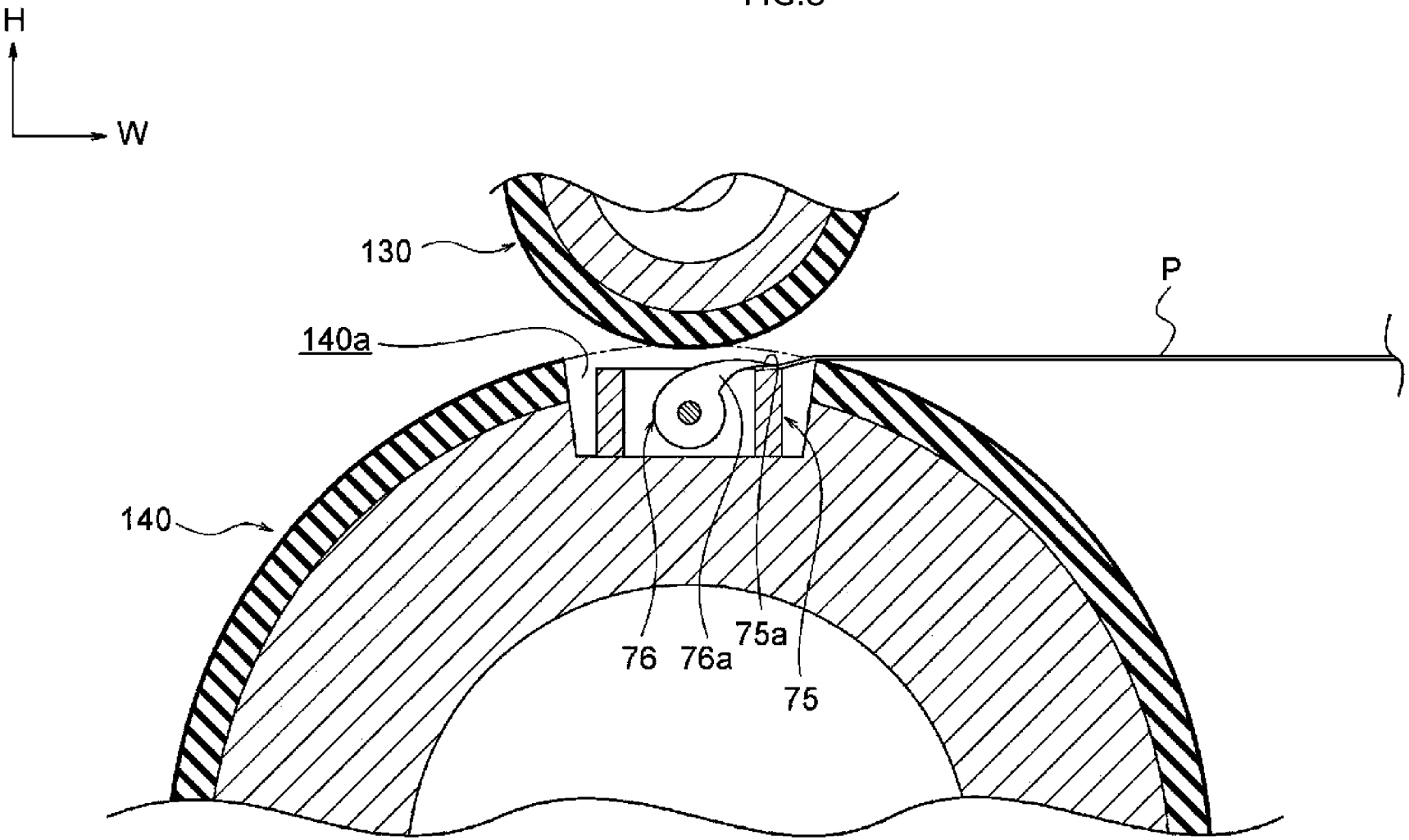
FIG. 8 is a cross-sectional view illustrating the main heating unit of the fixing device according to the exemplary embodiment of the present invention.

A recess 140*a* that extends in the apparatus depth direction is formed on the outer peripheral surface of the pressing roller 140. When the sheet member P passes between the pressing roller 140 and the heating roller 130, a gripper 76 that grips the leading end portion of the sheet member P is accommodated in the recess 140*a* as illustrated in FIG. 8.

As illustrated in FIG. 7, the pair of shaft portions 148 is formed at both end portions in the apparatus depth direction, and have a diameter smaller than that of the outer peripheral surface of the release layer 146 in the pressing roller 140, and extend in the axial direction.

In this configuration, the pressing roller 140 is rotated by a rotational force transmitted from a driving member (not shown). Then, the heating roller 130 is rotated by the rotating pressing roller 140, and the driven roller 150 is rotated following the rotating heating roller 130. Further, the heating roller 130 and the pressing roller 140 nip and transport the sheet member P to which the toner image is transferred, so that the toner image is fixed to the sheet member P.

—Others—

As illustrated in FIG. 7, the main heating unit 120 includes a support member 156 that supports the pressing roller 140, and a biasing member 158 that biases the pressing roller 140 toward the heating roller 130 via the support member 156.

A pair of support members 156 is provided. The pair of support members 156 is disposed so as to rotatably support the pair of shaft portions 148 of the pressing roller 140 from below.

Figure 9:
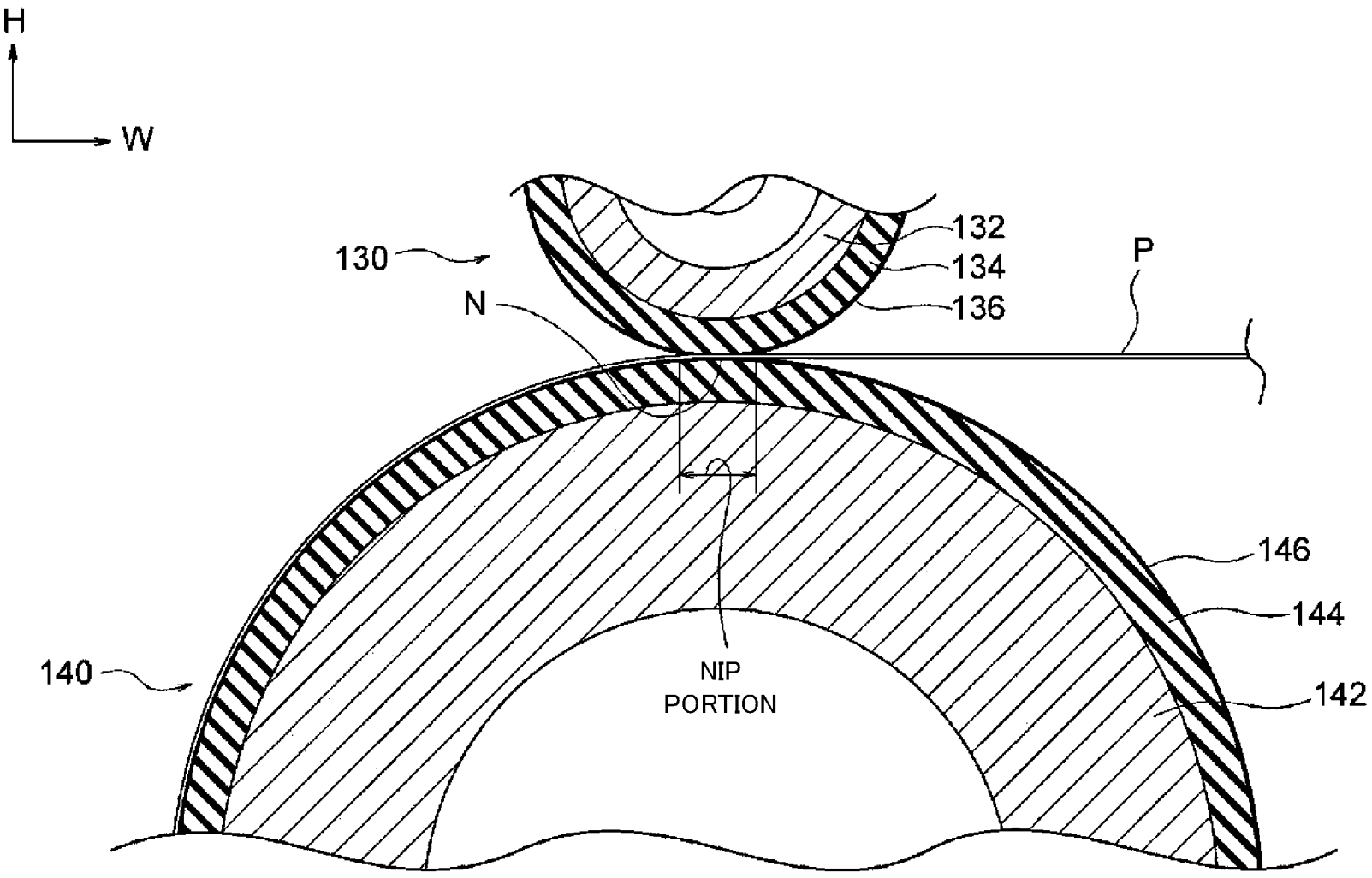
FIG. 9 is a cross-sectional view illustrating the main heating unit of the fixing device according to the exemplary embodiment of the present invention.

The biasing member 158 is a compression spring and a pair of biasing members is provided. The pair of biasing members 158 are disposed on a side opposite to the shaft portion 148 with respect to the support member 156. When the pair of biasing members 158 biases the pressing roller 140 toward the heating roller 130, the pressing roller 140 presses the sheet member P toward the heating roller 130 as described above. Then, as illustrated in FIG. 9, the heating roller 130 in the portion biased by the pressing roller 140 is deformed, and a nip portion N that is a region where the heating roller 130 and the pressing roller 140 are in contact with each other is formed.

Further, in the transport direction of the sheet member P, the distance (=the distance K1 shown in FIG. 1) from the fan 172 to the nip portion N of the main heating unit 120 is shorter than the length of the sheet member P having the minimum size in the transport direction. The minimum size is described in the handling manual of the image forming apparatus 10.

[Detection Unit 200]

As illustrated in FIG. 1, the detection unit 200 is disposed on the upstream side of the preheating unit 102, on the downstream side of the transfer device 30 (see FIG. 14) and below the transported sheet member P in the transport direction of the sheet member P. Further, the detection unit 200 includes four sensors 204*a*, 204*b*, 204*c*, and 204*d* (see FIG. 5). Hereinafter, when the sensors 204*a*, 204*b*, 204*c*, and 204*d* are not distinguished from each other, the alphabets at the end may be omitted.

Each of the sensors 204 is an optical sensor, and is configured to emit light below the sheet member P to the sheet surface and to detect a vertical position of a portion of the sheet member P where light is reflected when light reflected from the sheet surface is incident.

Figure 5:
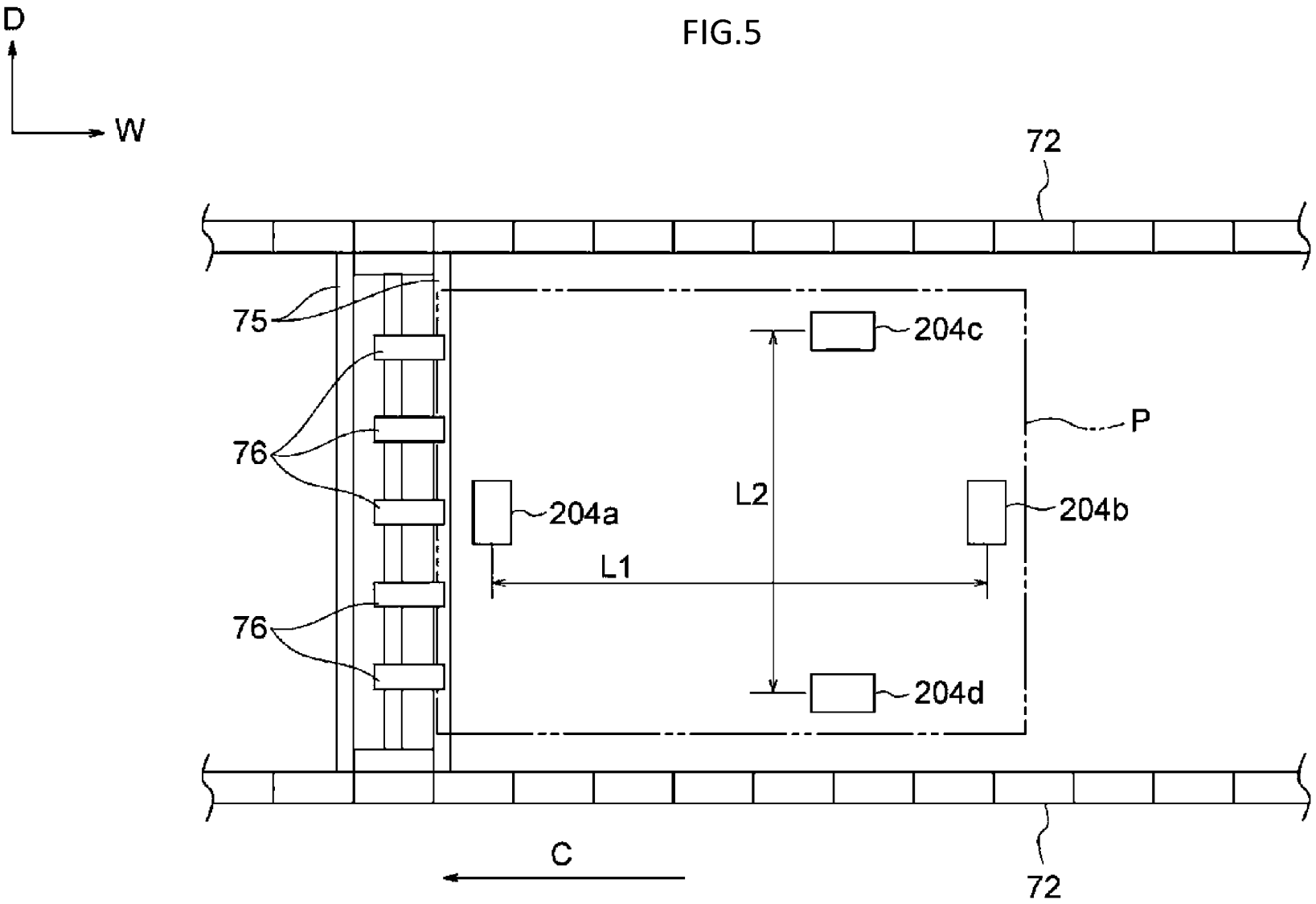
FIG. 5 is a plan view illustrating a detection unit of the fixing device according to the exemplary embodiment of the present invention.

As illustrated in FIGS. 5 and 6, the sensor 204*a* is disposed at an intermediate portion between one chain 72 and the other chain 72 in the apparatus depth direction. Further, the sensor 204*b* is disposed at the same position as the sensor 204*a* in the apparatus depth direction and on the upstream side of the sensor 204*a* in the transport direction of the sheet member P. The sensor 204*a* and the sensor 204*b* are separated from each other in the transport direction of the sheet member P. The distance (=the distance L1 shown in FIG. 5) between the sensor 204*a* and the sensor 204*b* when viewed from above is preferably shorter than the length of the sheet member P having the maximum size in the transport direction, more preferably shorter than the length of the sheet member P having the intermediate size in the transport direction, and particularly preferably shorter than the length of the sheet member P having the minimum size in the transport direction.

The sensor 204*c* is disposed between the one chain 72 and the other chain 72 in the apparatus depth direction between the sensor 204*a* and the sensor 204*b* in the apparatus width direction and on the one chain 72 side. The sensor 204*d* is disposed between the one chain 72 and the other chain 72 in the apparatus depth direction at the same position as the sensor 204*c* in the apparatus width direction and on the other chain 72 side. The sensor 204*c* and the sensor 204*d* are separated from each other in the width direction of the sheet member P. The distance (=the distance L2 shown in FIG. 5) between the sensor 204*c* and the sensor 204*d* as viewed from above the apparatus is preferably shorter than the length of the sheet member P of the maximum size in the width direction, more preferably shorter than the length of the sheet member P of the intermediate size in the width direction, and particularly preferably shorter than the length of the sheet member P of the minimum size in the width direction.

In this configuration, light is emitted from each sensor 204 to the sheet surface of the sheet member P from the time when the leading end portion of the sheet member P reaches above the sensor 204*b* until the rear end portion of the sheet member P passes above the sensor 204*a*, and is optically reflected by the sheet surface. When the light reflected by each sensor 204 is incident, each sensor 204 detects the position in the vertical direction of the portion of the sheet member P where the light is reflected.

Then, based on the detection results of the sensor 204*a* and the sensor 204*b*, the detection unit 200 detects the deflection of the sheet member P in the transport direction of the sheet member P. The detection unit 200 detects the deflection of the sheet member P in the width direction of the sheet member P based on the deflection in the transport direction of the sheet member P detected by the sensor 204*a* and the sensor 204*b* and the detection results of the sensor 204*c* and the sensor 204*d*. Thus, the detection unit 200 functions as a deflection detecting means that detects the deflection of the transported sheet member P.

Then, the detection unit 200 detects the deflection of the transported sheet member P to detect the transport posture of the sheet member P.

[Control Unit 230]

Figure 10:
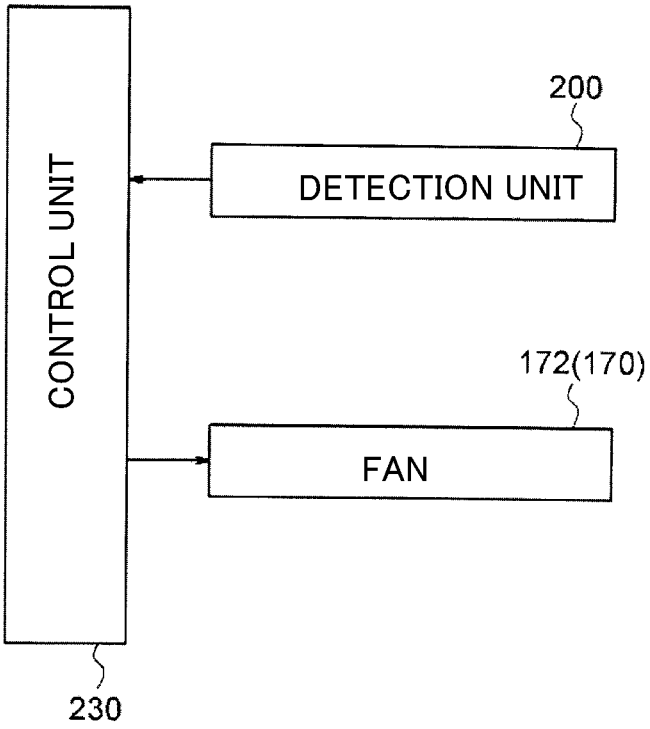
FIG. 10 is a block diagram illustrating a control system of the fixing device according to the exemplary embodiment of the present invention.

As illustrated in FIG. 10, the control unit 230 individually controls the fans 172 provided in the blowing unit 170 based on the detection result of the detection unit 200. The control of the control unit 230 with respect to the fans 172 will be described together with an operation described later.

(Operation of Configuration of Main Part)

Next, an operation of the fixing device 100 will be described in comparison with a fixing device 600 according to a comparative embodiment. First, with respect to a configuration of the fixing device 600 according to the comparative embodiment, portions different from those of the fixing device 100 will be mainly described.

[Fixing Device 600]

Figure 15:
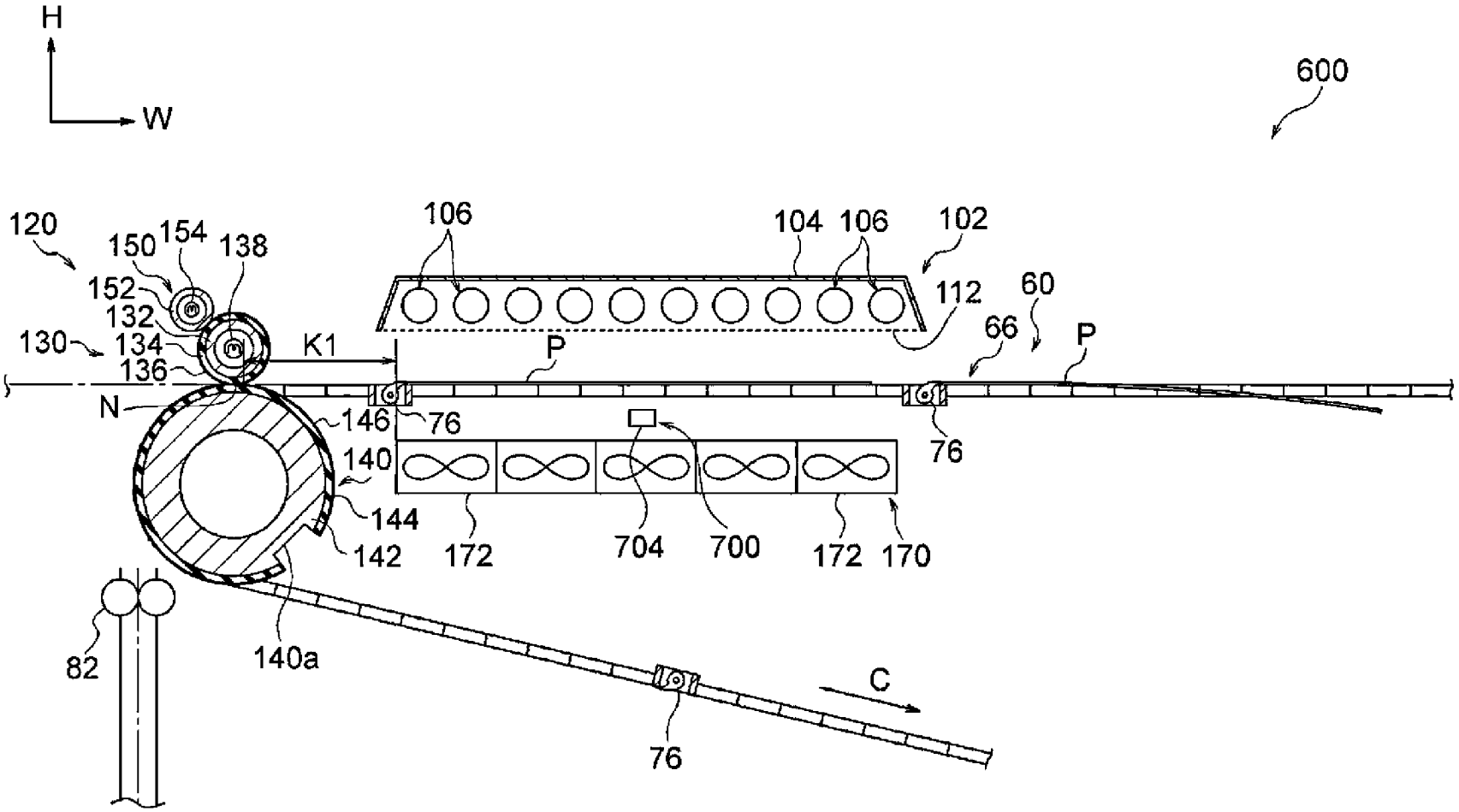
FIG. 15 is a configuration view illustrating a fixing device according to a comparative example of the present invention.

As illustrated in FIG. 15, the fixing device 600 includes a preheating unit 102, a main heating unit 120, a blowing unit 170, a detection unit 700 that detects the position of the sheet member P, and a control unit 730 (see FIG. 16) that controls each unit.

The detection unit 700 is disposed between the preheating unit 102 and the blowing unit 170 and below the transported sheet member P in the upper-lower direction. The detection unit 700 includes one sensor 704. The sensor 704 is an optical sensor, and is disposed at an intermediate portion between one chain 72 and the other chain 72 in the apparatus depth direction. Since light is emitted below the sheet member P to the sheet surface, and the light reflected from the sheet surface is incident, the sensor 704 detects the vertical position of the portion of the sheet member P where the light is reflected.

Figure 16:
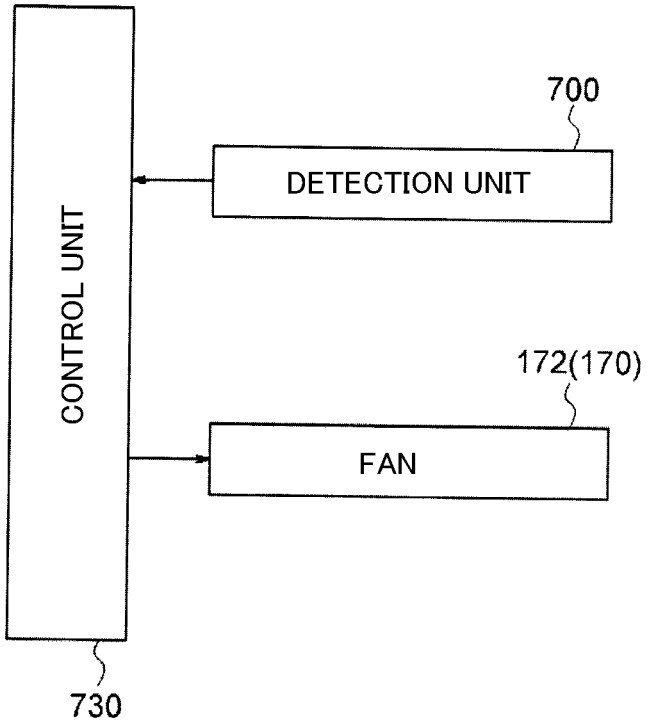
FIG. 16 is a block diagram illustrating a control system of a fixing device according to a comparative example of the present invention.

As illustrated in FIG. 16, the control unit 730 controls the fans 172 provided in the blowing unit 170 based on the detection result of the detection unit 700.

(Operation of Fixing Device 100, 600)

—Fixing Device 600—

In the fixing device 600, the preheating unit 102 heats the first sheet member P, from which the image forming operation is started, in a non-contact state. Since the sensor 704 detects the transport posture of the first sheet member P, when the preheating unit 102 heats the first sheet member P, the fans 172 of the blowing unit 170 are not operating. In addition, the control unit 730 has obtained in advance the size of the sheet member P input by the user.

In the sensor 704 of the detection unit 700, light is emitted from the sensor 704 to the sheet surface of the sheet member P from the time when the leading end portion of the first sheet member P reaches above the sensor 704 until the rear end portion of the sheet member P passes above the sensor 704, and is reflected by the sheet surface. When the light reflected by the sensor 704 is incident, the vertical position of the portion of the sheet member P where the light is reflected is detected.

In addition, the main heating unit 120 nips the sheet member P heated by the preheating unit 102 by the heating roller 130 and the pressing roller 140, and fixes the toner image to the sheet member P. The sheet member P to which the toner image is fixed is discharged to the outside of the apparatus through the cooling unit 90 (see FIG. 14).

Further, when the preheating unit 102 heats the second sheet member P, the control unit 730 uniformly controls the rotation speeds of the fans 172 based on the detection result of the detection unit 700. Specifically, the control unit 730 uniformly controls the rotation speeds of all the fans 172 such that the sheet surface of the sheet member P holding the leading end portion faces the preheating unit 102 in the upper-lower direction. For example, when the degree of deflection of the sheet member P is large, the control unit 730 increases the rotation speeds of all the fans 172 rotating at the same rotation speed, and when the degree of deflection of the sheet member P is small, the control unit 730 decreases the rotation speeds of all the fans 172 rotating at the same rotation speed.

As described above, in the fixing device 600, the detection unit 700 detects the transport posture of the sheet member P by the first sheet member P, and the fans 172 blow the air from the second sheet member P. That is, the transport posture cannot be stabilized from the first sheet member P heated by the preheating unit 102.

—Fixing Device 100—

Figure 2A:
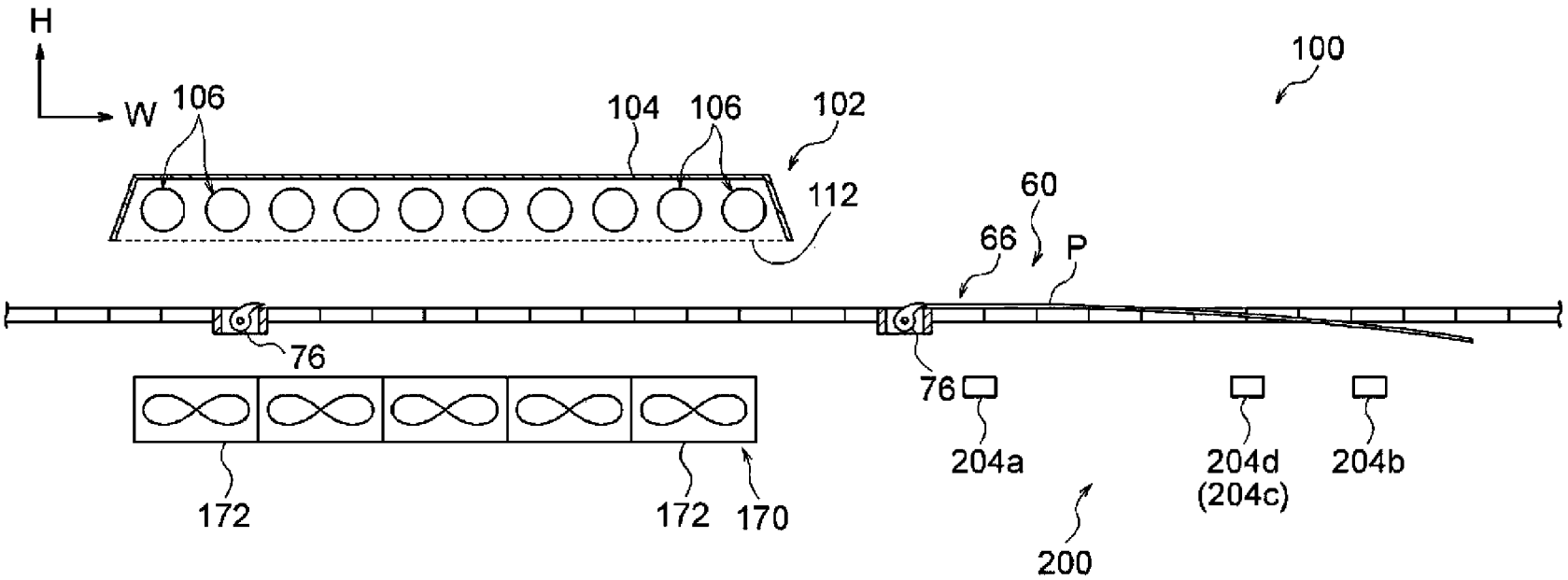
FIG. 2A is a process view illustrating a heating process for heating a sheet member in the fixing device according to the exemplary embodiment of the present invention.
Figure 2B:
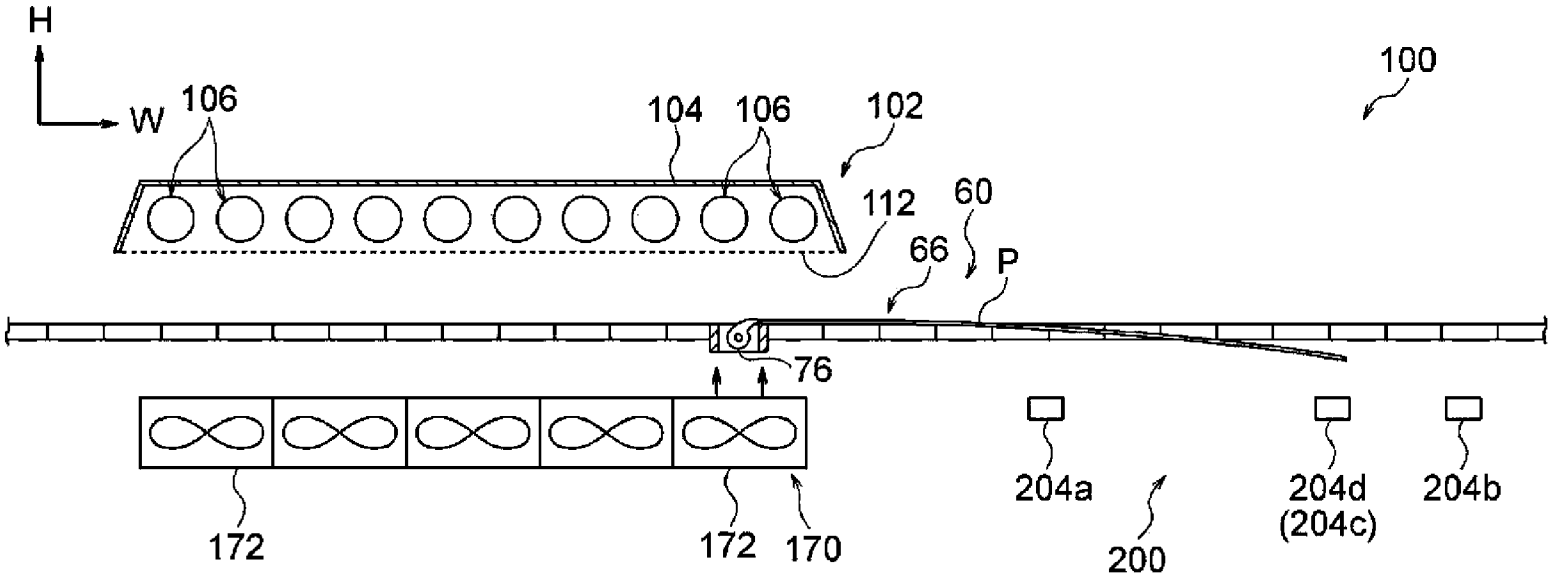
FIG. 2B is a process view illustrating a heating process for heating a sheet member in the fixing device according to the exemplary embodiment of the present invention.
Figure 3A:
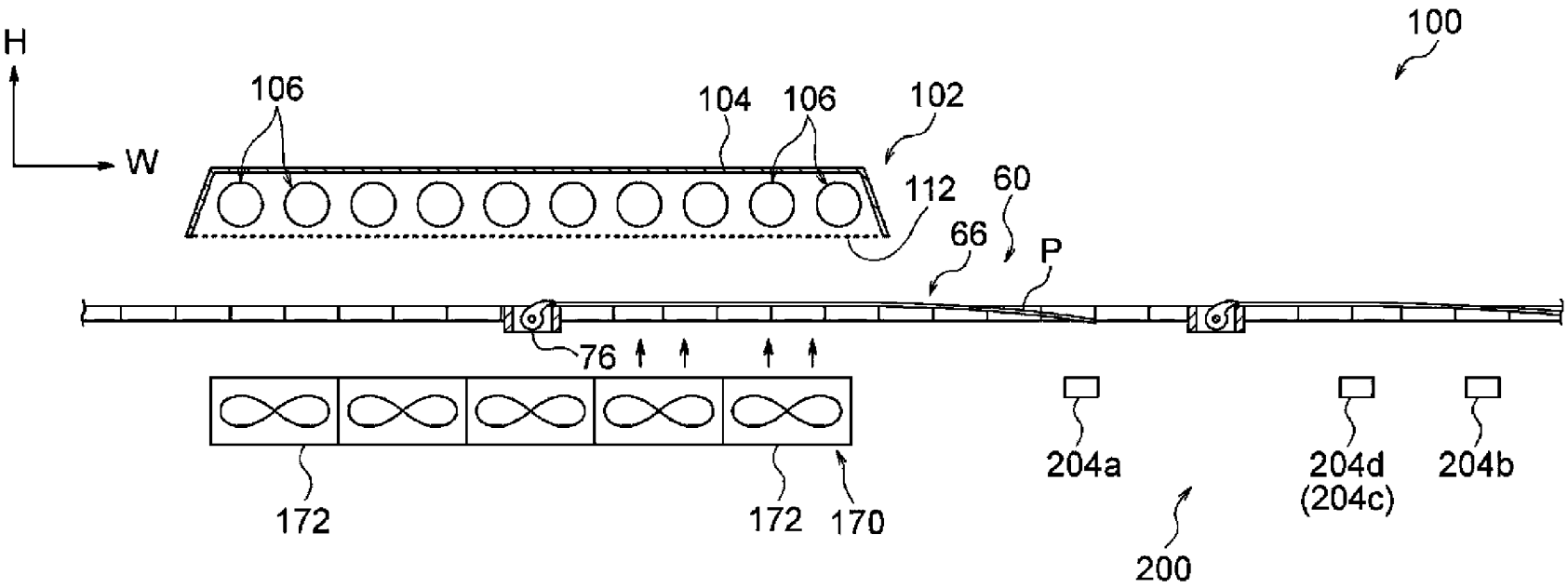
FIG. 3A is a process view illustrating a heating process for heating a sheet member in the fixing device according to the exemplary embodiment of the present invention.
Figure 3B:
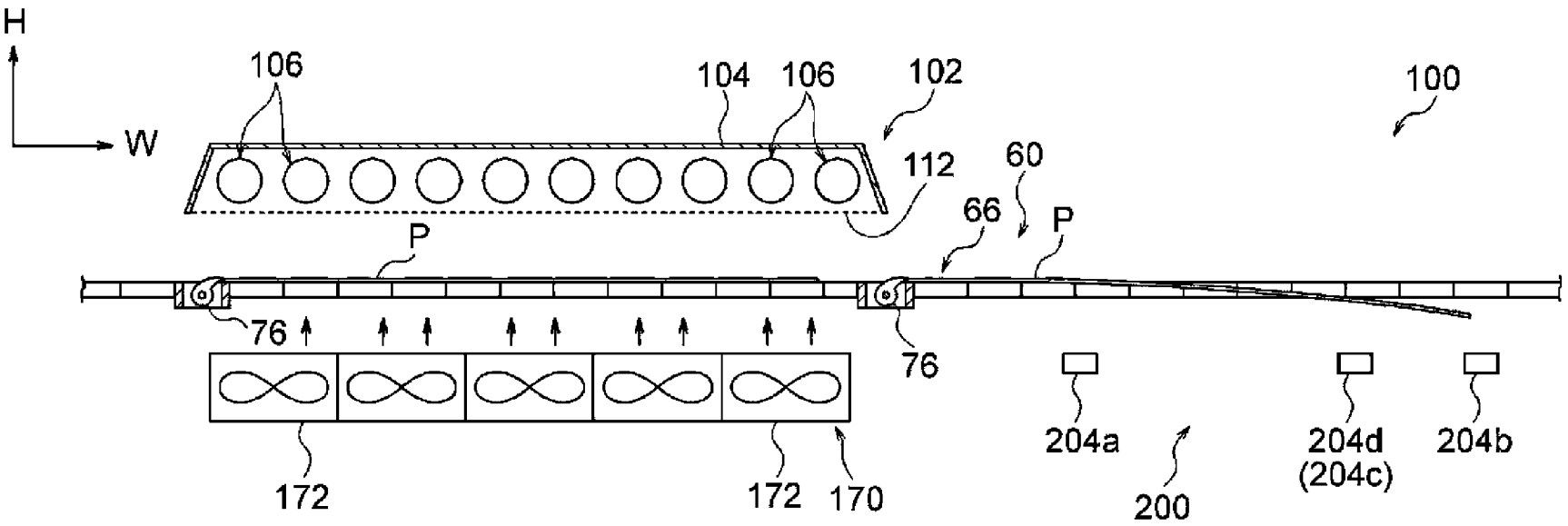
FIG. 3B is a process view illustrating a heating process for heating a sheet member in the fixing device according to the exemplary embodiment of the present invention.

In the fixing device 100, as illustrated in FIG. 2A, when the leading end portion of the first sheet member P to which the toner image is transferred reaches above the sensor 204*a*, light is emitted from each sensor 204 to the sheet surface of the sheet member P, and light is reflected by the sheet surface. When the light reflected by each sensor 204 is incident, the sensor 204 detects the vertical position of the portion of the sheet member P where the light is reflected. As a result, the detection unit 200 detects the deflection of the sheet member P in the transport direction and the deflection of the sheet member P in the width direction of the sheet member P. The control unit 230 has obtained the size of the sheet member P input by the user in advance.

Further, when the preheating unit 102 heats the first sheet member P, the control unit 230 controls the rotation speed of each of the fans 172 individually by operating each of the fans 172 based on the detection result of the detection unit 200.

Specifically, the control unit 230 controls the fans 172 such that the sheet surface of the sheet member P faces the preheating unit 102 in the upper-lower direction, and increases the amount of air blown to the rear end side portion of the sheet member P as compared with the amount of air blown to the leading end side portion of the sheet member P. That is, the control unit 203 gradually increases the amount of air blown onto the sheet surface from the time when the leading end side portion of the sheet member P passes above the fan 172 until the rear end side portion of the sheet member P passes. In other words, the control unit 230 sets the amount of air blown to the rear end side portion of the sheet member P to be larger than the amount of air blown to the leading end side portion of the sheet member P with respect to one fan 172.

Further, the control unit 230 controls the fans 172 to gradually change the amount of air blown to the sheet member P in the transport direction of the sheet member P. In this manner, the control unit 230 suppresses the sheet member P from being deflected in the transport direction of the sheet member P.

Further, the control unit 230 controls the fans 172 such that the sheet surface of the sheet member P faces the preheating portion 102 in the upper-lower direction, and increases the amount of air blown to the portion of the sheet member P on the edge side in the width direction as compared with the amount of air blown to the portion of the sheet member P on the center side in the width direction. In other words, the control unit 230 increases the amount of air blown from the fans 172 disposed on both end sides (=the edge side in the width direction) in the apparatus width direction compared to the amount of air blown from the fans 172 disposed on the center side (=the center side in the width direction) in the apparatus width direction.

Further, the control unit 230 controls the fans 172 to gradually change the amount of air blown to the sheet member P in the width direction of the sheet member P. In this manner, the control unit 230 suppresses the sheet member P from being deflected such that the outer portion of the sheet member P in the width direction is positioned below the inner portion of the sheet member P in the width direction.

Figure 12:
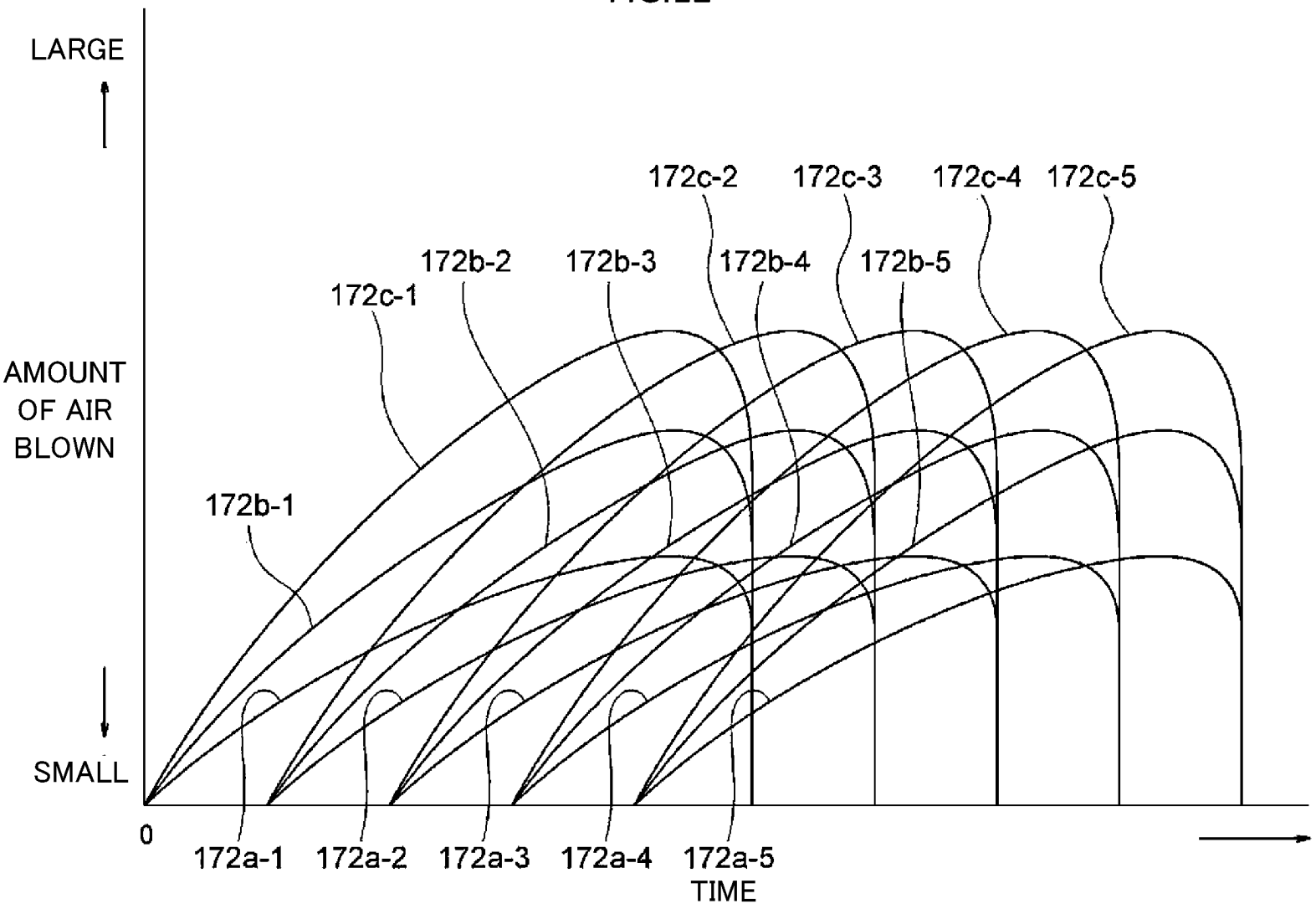
FIG. 12 is a cross-sectional view illustrating a cooling unit of an image forming apparatus according to the exemplary embodiment of the present invention.

FIG. 12 shows a graph in which the horizontal axis represents time and the vertical axis represents the amount of air blown onto the sheet member P by the fans 172. In the fans 172 in the central portion in the apparatus width direction, when the fan 172*a*-1, the fan 172*a*-2, the fan 172*a*-3, the fan 172*a*-4, and the fan 172*a*-5 are set from the upstream side in the transport direction, the amount of air blown out from each fan 172 is adjusted as shown in the graph of FIG. 12.

Further, when the fan 172 on both sides in the width direction with respect to the fan 172*a* is the fan 172*b*, and the fan 172*b*-1, the fan 172*b*-2, the fan 172*b*-3, the fan 172*b*-4, and the fan 172*b*-5 are set from the upstream side in the transport direction, the amount of air blown out from each fan 172 is adjusted as shown in the graph of FIG. 12.

Further, when the fan 172 on the edge side in the width direction with respect to the fan 172*b* is the fan 172*c*, and the fan 172*c*-1, the fan 172*c*-2, the fan 172*c*-3, the fan 172*c*-4, and the fan 172*c*-5 are set from the upstream side in the transport direction, the amount of air blown out from each fan 172 is adjusted as illustrated in the graph of FIG. 12.

As a result, in the fixing device 100, as illustrated in FIGS. 2A and 2B, FIGS. 3A and 3B, the transport posture may be stabilized from the first sheet member P heated by the preheating unit. Further, since the transport posture of the sheet member P is stabilized, the preheating unit 102 uniformly heats the entire sheet member P from the first sheet member P.

SUMMARY

As described above, in the fixing device 100, the detection unit 200 is disposed on the upstream side of the preheating unit 102 in the transport direction of the sheet member P. Therefore, as compared with the case of using the fixing device 600, the transport posture of the first sheet member P heated by the preheating unit 102 is stabilized.

Further, in the fixing device 100, the control unit 230 sets the amount of air blown to the rear end side portion of the transported sheet member P to be larger than the amount of air blown to the leading end side portion of the sheet member P with respect to one fan 172. Therefore, compared to a case where the amount of air blown from the fans 172 to the sheet member P is always constant, the transport posture of the sheet member P is stabilized.

In the fixing device 100, plural fans 172 are arranged in the transport direction of the sheet member P. The control unit 230 controls the plural fans 172 to increase the amount of air blown to the rear end portion of the sheet member P as compared with the amount of air blown to the leading end portion of the sheet member P. Therefore, in the configuration in which the plural fans 172 are arranged in the transport direction of the sheet member P, the transport posture of the sheet member P is stabilized as compared with the case where the amount of air blown from all the fans 172 arranged in the transport direction of the sheet member P to the sheet member P is the same.

In the fixing device 100, the control unit 230 controls the fans 172 to gradually change the amount of air blown to the sheet member P in the transport direction of the sheet member P. Therefore, the transport posture of the sheet member P is stabilized as compared with the case where the amount of air blown to the sheet member P in the transport direction of the sheet member P is only two of the maximum amount and the minimum amount.

In the fixing device 100, plural fans 172 are arranged in the width direction of the sheet member P. Then, the control unit 230 controls the plural fans 172 to increase the amount of air blown to the outer portion of the sheet member P in the width direction as compared with the amount of air blown to the inner portion of the sheet member P in the width direction. Therefore, in the configuration in which the plural fans 172 are arranged in the width direction of the sheet member P, the transport posture of the sheet member P is stabilized as compared with the case where the amount of air blown from all the fans 172 arranged in the width direction of the sheet member P to the sheet member P is the same.

In the fixing device 100, the control unit 230 controls the fans 172 to gradually change the amount of air blown to the sheet member P in the width direction of the sheet member P. Therefore, the transport posture of the sheet member P is stabilized as compared with the case where the amount of air blown to the sheet member P in the width direction of the sheet member P is only two of the maximum amount and the minimum amount.

In the fixing device 100, the plural sensors 204 of the detection unit 200 are disposed side by side in the transport direction of the sheet member P, and are disposed side by side in the width direction of the sheet member P. Therefore, as compared with a case where only one sensor is provided, the transport posture of the sheet member P in a state where air is not blown by the fan 172 is detected with high accuracy.

In the fixing device 100, the distance (=the distance K1 shown in FIG. 1) from the fan 172 to the nip portion N of the main heating unit 120 in the transport direction of the sheet member P is shorter than the length of the sheet member P having the minimum size in the transport direction. Therefore, air is blown to at least the rear end portion of the sheet member P until the leading end portion of the transported sheet member P is nipped by the nip portion N of the main heating portion 120. As a result, as compared with the case where the distance from the fan 172 to the nip portion N of the main heating unit 120 is longer than the length of the sheet member P having the minimum size, the transport posture when the sheet member P having the minimum size is nipped by the nip portion N is stabilized.

In the image forming apparatus 10, the image forming apparatus 10 includes the fixing device 100. Therefore, as compared with the case where the fixing device 600 is provided, the entire sheet member P is uniformly heated by the preheating unit 102 from the first sheet member P.

Further, in the image forming apparatus 10, since the entire sheet member P is uniformly heated by the preheating unit 102 from the first sheet member P, the quality degradation of the image formed on the first sheet member P is suppressed as compared with the case where the fixing device 600 is provided.

Although the present invention is described in detail with reference to specific exemplary embodiments, it is apparent to those skilled in the art that the present invention is not limited to the exemplary embodiments, and various other exemplary embodiments may be taken within the scope of the present invention. For example, although not particularly described in the above exemplary embodiment, the control of the fans 172 by the control unit 230 may be performed, for example, for each sheet, may be performed for each job, or may be performed for each sheet type.

In the above exemplary embodiment, the control unit 230 individually controls the rotation speed of each of the fans 172; but the control unit 230 may partition the blowing unit 170 in the transport direction of the sheet member P and the width direction of the sheet member P to control the fans 172 for each partitioned region.

In the above exemplary embodiment, the control unit 230 individually controls the rotation speed of each of the fans 172, but the rotation speed of each of the fans 172 may be the same. However, in this case, the effect of individually controlling the rotation speed of each of the fans 172 is not achieved.

In the above exemplary embodiment, two sensors 204 of the detection unit 200 are disposed side by side in the transport direction of the sheet member P, and two sensors 204 are disposed side by side in the width direction of the sheet member P. However, three or more sensors 204 may be disposed side by side.

Further, in the above exemplary embodiment, air is blown to the sheet member P by using the fans 172, but for example, air may be blown from the tip end of the duct by using a duct, and the air may be blown to the sheet member P.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a preheating unit configured to heat a recording medium above the recording medium in a non-contact state with the recording medium, the recording medium being held at a leading end of the recording medium having a recording surface on which an image is transferred, the recording medium being transported such that the recording surface faces upward;

a blowing unit disposed on a side opposite to the preheating unit with respect to the recording medium and configured to blow air onto the recording medium below the recording medium;

a main heating unit disposed on a downstream side of the preheating unit in a transport direction of the recording medium and configured to contact the recording medium to heat the recording medium;

a detection unit disposed on an upstream side of the preheating unit in the transport direction and configured to detect a transport posture of the recording medium; and a control unit configured to control the blowing unit based on a detection result of the detection unit to adjust an amount of air to be blown to the recording medium.

2. The fixing device according to claim 1, wherein the control unit controls the blowing unit to increase the amount of air blown to a portion on a rear end side of the transported recording medium compared to the amount of air blown to a portion on the leading end side of the recording medium.

3. The fixing device according to claim 1, comprising a plurality of blowing units disposed in the transport direction, wherein the control unit controls the plurality of blowing units to increase the amount of air blown to a portion on a rear end side of the recording medium compared to the amount of air blown to the portion on the leading end side of the recording medium.

4. The fixing device according to claim 3, wherein the control unit controls the blowing units to gradually change the amount of air blown onto the recording medium in the transport direction.

5. The fixing device according to claim 1, comprising a plurality of the blowing units disposed in a width direction of the transported recording medium, wherein the control unit controls the plurality of blowing units to increase the amount of air blown to portions of the recording medium on the edge sides in the width direction compared to the amount of air blown to a portion of the recording medium on the center side in the width direction.

6. The fixing device according to claim 2, comprising a plurality of the blowing units disposed in a width direction of the transported recording medium, wherein the control unit controls the plurality of blowing units to increase the amount of air blown to portions of the recording medium on the edge sides in the width direction compared to the amount of air blown to a portion of the recording medium on the center side in the width direction.

7. The fixing device according to claim 3, wherein the plurality of the blowing units are disposed in a width direction of the transported recording medium, and the control unit controls the plurality of blowing units to increase the amount of air blown to portions of the recording medium on the edge sides in the width direction compared to the amount of air blown to a portion of the recording medium on the center side in the width direction.

8. The fixing device according to claim 4, wherein the plurality of the blowing units are disposed in a width direction of the transported recording medium, and the control unit controls the plurality of blowing units to increase the amount of air blown to portions of the recording medium on the edge sides in the width direction compared to the amount of air blown to a portion of the recording medium on the center side in the width direction.

9. The fixing device according to claim 5, wherein the control unit controls the blowing units to gradually change the amount of air blown onto the recording medium in the width direction.

10. The fixing device according to claim 6, wherein the control unit controls the blowing units to gradually change the amount of air blown onto the recording medium in the width direction.

11. The fixing device according to claim 7, wherein the control unit controls the blowing units to gradually change the amount of air blown onto the recording medium in the width direction.

12. The fixing device according to claim 8, wherein the control unit controls the blowing units to gradually change the amount of air blown onto the recording medium in the width direction.

13. The fixing device according to claim 1, wherein the detection unit comprises a plurality of sensors disposed apart from each other in the transport direction and disposed apart from each other in the width direction of the recording medium.

14. The fixing device according to claim 2, wherein the detection unit comprises a plurality of sensors disposed apart from each other in the transport direction and disposed apart from each other in the width direction of the recording medium.

15. The fixing device according to claim 3, wherein the detection unit comprises a plurality of sensors disposed apart from each other in the transport direction and disposed apart from each other in the width direction of the recording medium.

16. The fixing device according to claim 4, wherein the detection unit comprises a plurality of sensors disposed apart from each other in the transport direction and disposed apart from each other in the width direction of the recording medium.

17. The fixing device according to claim 5, wherein the detection unit comprises a plurality of sensors disposed apart from each other in the transport direction and disposed apart from each other in the width direction of the recording medium.

18. The fixing device according to claim 6, wherein the detection unit comprises a plurality of sensors disposed apart from each other in the transport direction and disposed apart from each other in the width direction of the recording medium.

19. The fixing device according to claim 1, wherein a distance from the blowing unit to the main heating unit in the transport direction is shorter than a length of the recording medium having a minimum size in the transport direction.

20. An image forming apparatus comprising:

a transfer unit configured to transfer the image onto the recording medium; and the fixing device according to claim 1, configured to fix the image transferred to the recording medium to the recording medium.

* * * * *